US009793602B2

(12) United States Patent
Aminzadeh et al.

(10) Patent No.: US 9,793,602 B2
(45) Date of Patent: Oct. 17, 2017

(54) MULTIBAND MIMO VEHICULAR ANTENNA ASSEMBLIES

(71) Applicant: Laird Technologies, Inc., Earth City, MO (US)

(72) Inventors: Mehran Aminzadeh, Braunschweig (DE); Ahmed Ameri, Witzenhausen (DE); Jens Gallhoff, Hildesheim (DE); Ulrich Steinkamp, Hannover (DE)

(73) Assignee: Laird Technologies, Inc., Earth City, MO (US)

( * ) Notice: Subject to any disclaimer, the term of this patent is extended or adjusted under 35 U.S.C. 154(b) by 90 days.

(21) Appl. No.: 14/973,045

(22) Filed: Dec. 17, 2015

(65) Prior Publication Data

US 2016/0104932 A1 Apr. 14, 2016

Related U.S. Application Data

(63) Continuation of application No. PCT/US2013/050357, filed on Jul. 12, 2013.

(Continued)

(51) Int. Cl.
*H01Q 1/42* (2006.01)
*H01Q 1/32* (2006.01)

(Continued)

(52) U.S. Cl.
CPC ..... *H01Q 1/3275* (2013.01); *H01Q 1/32* (2013.01); *H01Q 1/38* (2013.01); *H01Q 1/405* (2013.01);

(Continued)

(58) Field of Classification Search
USPC ..... 343/872, 713, 725
See application file for complete search history.

(56) References Cited

U.S. PATENT DOCUMENTS 5,619,215 A * 4/1997 Sydor ..... H01Q 3/08 343/765
7,173,576 B2 * 2/2007 O'Neill ..... H01Q 11/08 343/702

(Continued)

FOREIGN PATENT DOCUMENTS

CN 201927699 U 8/2011
CN 102714349 A 10/2012

(Continued)

OTHER PUBLICATIONS

Second Chinese office action dated Nov. 15, 2016 for Chinese application No. 201410280280.6 which claims priority to the same parent application as the instant application, 7 pages.

(Continued)

*Primary Examiner* — Jessica Han
*Assistant Examiner* — Hai Tran
(74) *Attorney, Agent, or Firm* — Harness, Dickey & Pierce, P.L.C.

(57) ABSTRACT

Disclosed are exemplary embodiments of multiband MIMO vehicular antenna assemblies. In an exemplary embodiment, a multiband MIMO vehicular antenna assembly generally includes a chassis and an outer cover or radome. The outer cover is coupled to the chassis such that an interior enclosure is collectively defined by the outer cover and the chassis. An antenna carrier or inner radome is within the interior enclosure. The antenna carrier has inner and outer surfaces spaced apart from the chassis and the outer cover. One or more antenna elements are along and/or in conformance with the outer surface of the antenna carrier so as to generally follow the contour of a corresponding portion of the antenna carrier.

23 Claims, 23 Drawing Sheets

Related U.S. Application Data

(60) Provisional application No. 61/838,125, filed on Jun. 21, 2013.

(51) Int. Cl.

| | |
|---|---|
| ***H01Q 1/38*** | (2006.01) |
| ***H01Q 1/40*** | (2006.01) |
| ***H01Q 21/28*** | (2006.01) |
| ***H01Q 9/42*** | (2006.01) |
| ***H01Q 5/40*** | (2015.01) |
| ***H01R 13/24*** | (2006.01) |

(52) U.S. Cl.

CPC ..... *H01Q 1/42* (2013.01); *H01Q 5/40* (2015.01); *H01Q 9/42* (2013.01); *H01Q 21/28* (2013.01); *H01R 13/2414* (2013.01)

(56) References Cited

U.S. PATENT DOCUMENTS

| | | | | |
|---|---|---|---|---|
| 7,181,172 | B2 | 2/2007 | Sullivan et al. | |
| 7,429,958 | B2 | 9/2008 | Lindackers et al. | |
| 7,492,319 | B2 | 2/2009 | Lindackers et al. | |
| 7,755,551 | B2 | 7/2010 | Lindackers et al. | |
| 7,804,450 | B2 | 9/2010 | Sullivan et al. | |
| 9,178,272 | B2 | 11/2015 | Chakam et al. | |
| 2004/0171287 | A1 | 9/2004 | Spiropoulos | |
| 2010/0066615 | A1* | 3/2010 | Okayama | H01Q 1/243 343/702 |
| 2010/0149050 | A1 | 6/2010 | Ostervall et al. | |
| 2010/0265145 | A1 | 10/2010 | Chung | |
| 2010/0277379 | A1 | 11/2010 | Lindackers et al. | |
| 2011/0221640 | A1* | 9/2011 | Huber | H01Q 1/1214 343/713 |
| 2011/0300489 | A1 | 12/2011 | Palin | |
| 2012/0001811 | A1 | 1/2012 | Yoo et al. | |
| 2012/0274519 | A1* | 11/2012 | Chakam | H01Q 1/3275 343/702 |

FOREIGN PATENT DOCUMENTS

| | | | |
|---|---|---|---|
| CN | 103094682 | A | 5/2013 |
| DE | 19706153 | A1 | 8/1998 |
| DE | 102005054286 | A1 | 5/2007 |
| EP | 1793449 | | 6/2007 |
| JP | 2004-228909 | | 8/2004 |
| KR | 10-2011-0066639 | | 6/2011 |
| SE | 519652 | C2 | 3/2003 |
| WO | 2012-044968 | | 4/2012 |
| WO | 2013-090783 | | 6/2013 |
| WO | 2014-204494 | | 12/2014 |

OTHER PUBLICATIONS

International Search Report and Written Opinion dated Mar. 20, 2014 for PCT International Application No. PCT/US2013/050357 filed Jul. 12, 2013 (published as WO 2014/204494 on Dec. 24, 2014) which claims priority to the same parent application as the instant application; 10 pages.

http://en.wikipedia.org/wiki/Molded_interconnet_device; accessed Jun. 21, 2013; 3 pages.

Chinese Office Action dated Apr. 26, 2016 for Chinese application No. 201410280280.6 which claims priority to the same parent application as the instant application; 8 pages.

Supplementary European Search Report dated May 24, 2016 issued for European patent application No. 13887316.1 which claims priority to the same parent application as the instant application; 5 pages.

* cited by examiner

MIMO 2

Freq (600.0MHz to 3.000GHz)
Indep(VSWR_cmplx) (0.000 to 200.000)

MULTIBAND MIMO VEHICULAR ANTENNA ASSEMBLIES

CROSS-REFERENCE TO RELATED APPLICATIONS

This application is a U.S. Continuation Patent Application of PCT International Application Number PCT/US2013/050357 filed Jul. 12, 2013 (published as WO 2014/204494 on Dec. 24, 2014) which claims priority to and the benefit of U.S. Provisional Patent Application No. 61/838,125 filed Jun. 21, 2013. The entire disclosures of the above applications are incorporated herein by reference.

FIELD

The present disclosure generally relates to multiband MIMO vehicular antenna assemblies.

BACKGROUND

This section provides background information related to the present disclosure which is not necessarily prior art.

Various different types of antennas are used in the automotive industry, including AM/FM radio antennas, satellite digital audio radio service antennas, global positioning system antennas, cell phone antennas, etc. Multiband antenna assemblies are also commonly used in the automotive industry. A multiband antenna assembly typically includes multiple antennas to cover and operate at multiple frequency ranges. A printed circuit board (PCB) having radiating antenna elements is a typical component of the multiband antenna assembly.

Automotive antennas may be installed or mounted on a vehicle surface, such as the roof, trunk, or hood of the vehicle to help ensure that the antennas have unobstructed views overhead or toward the zenith. The antenna may be connected (e.g., via a coaxial cable, etc.) to one or more electronic devices (e.g., a radio receiver, a touchscreen display, GPS navigation device, cellular phone, etc.) inside the passenger compartment of the vehicle, such that the multiband antenna assembly is operable for transmitting and/or receiving signals to/from the electronic device(s) inside the vehicle.

SUMMARY

This section provides a general summary of the disclosure, and is not a comprehensive disclosure of its full scope or all of its features.

According to various aspects, exemplary embodiments are disclosed of multiband MIMO vehicular antenna assemblies. In an exemplary embodiment, a multiband MIMO vehicular antenna assembly generally includes a chassis and an outer radome. The outer radome is coupled to the chassis such that an interior enclosure is collectively defined by the outer radome and the chassis. An inner radome is within the interior enclosure. The inner radome has inner and outer surfaces spaced apart from the chassis and the outer radome. One or more antenna elements are along and/or in conformance with the outer surface of the inner radome so as to generally follow the contour of a corresponding portion of the inner radome.

In another exemplary embodiment, a multiband MIMO vehicular antenna assembly generally includes a chassis and an outer cover. The outer cover is coupled to the chassis such that an interior enclosure is collectively defined by the outer cover and the chassis. An antenna carrier is within the interior enclosure. The antenna carrier has inner and outer surfaces spaced apart from the chassis and the outer cover. One or more antenna elements are along and/or in conformance with the outer surface of the antenna carrier so as to generally follow the contour of a corresponding portion of the antenna carrier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
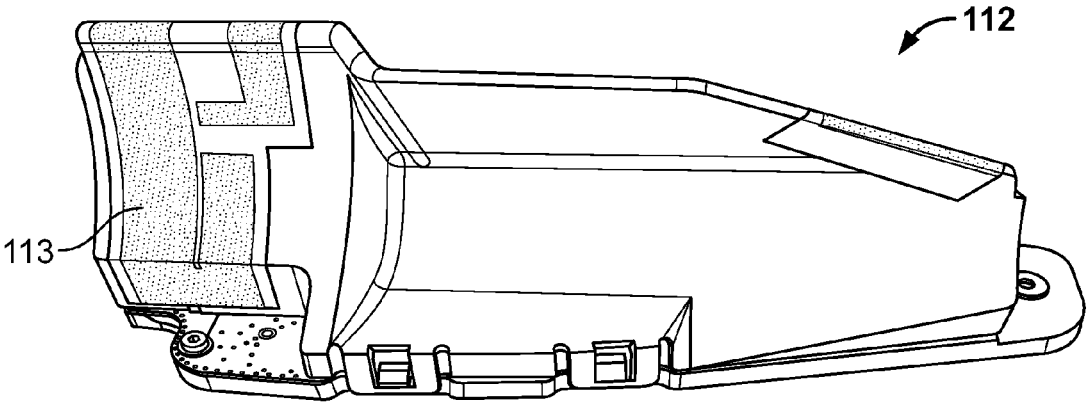
FIG. 3 is a perspective view of the inner radome, cover, housing, or antenna carrier shown in FIG. 2, and also illustrating a first MIMO antenna along an outer surface of a back portion of the inner radome.
Figure 4:
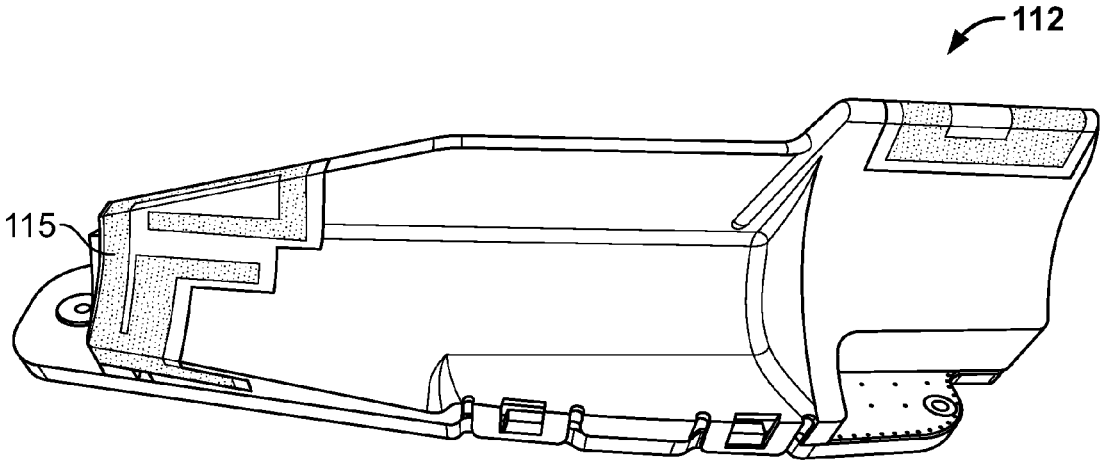
FIG. 4 is a perspective view of the inner radome shown in FIG. 3, and illustrating the opposite side thereof and a second MIMO antenna along an outer surface of a front portion the inner radome.
Figure 5:
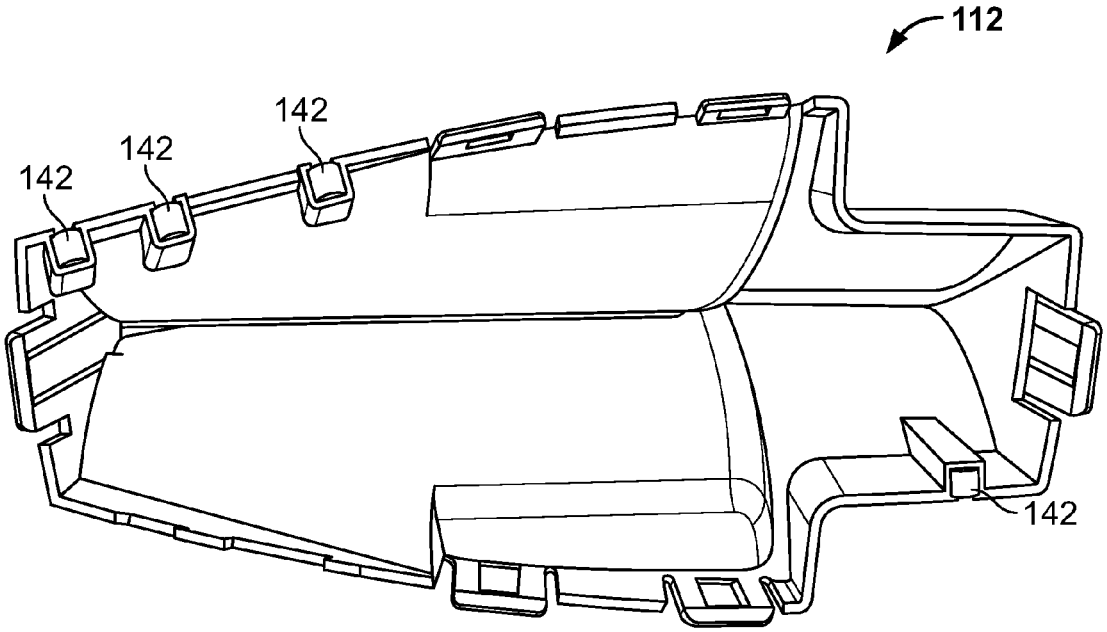
FIG. 5 is a perspective view of the inner radome shown in FIG. 3, and illustrating the interior thereof and molded interconnect devices (MID) for electrically connecting the first and second MIMO antennas to corresponding electrically conductive portions (e.g., traces, etc.) of a printed circuit board.
Figure 17:
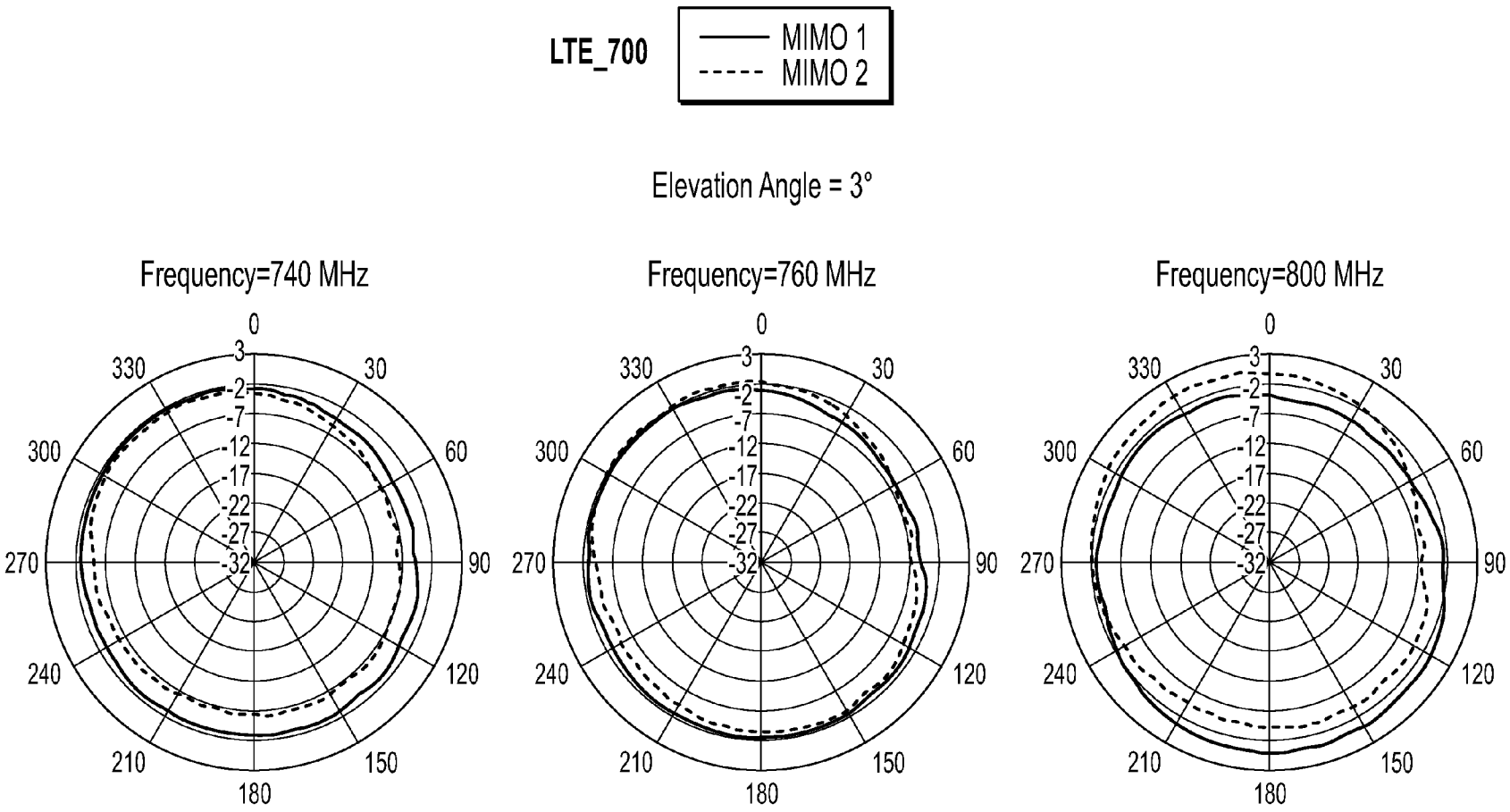
Figure 18:
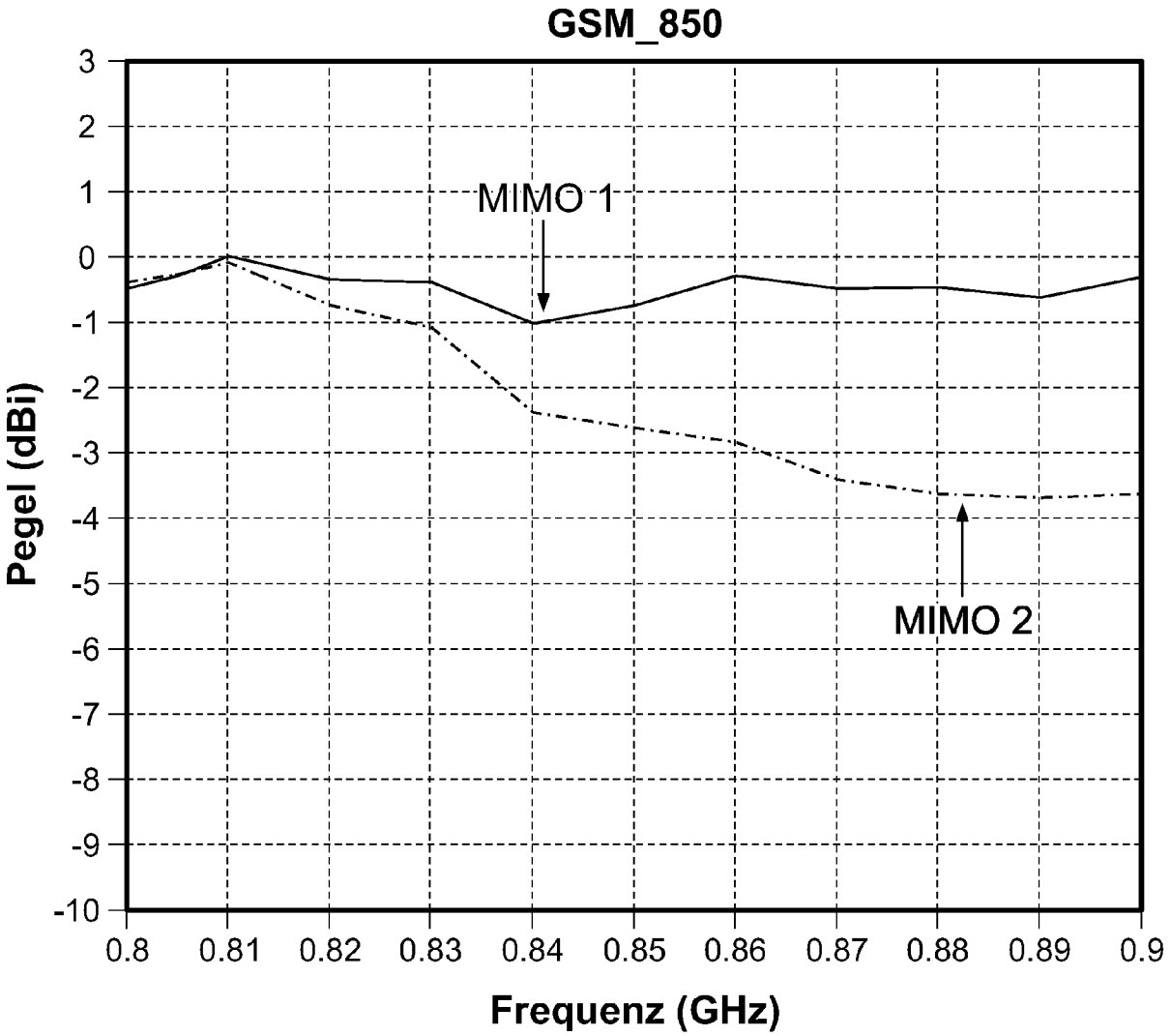
Figure 19:
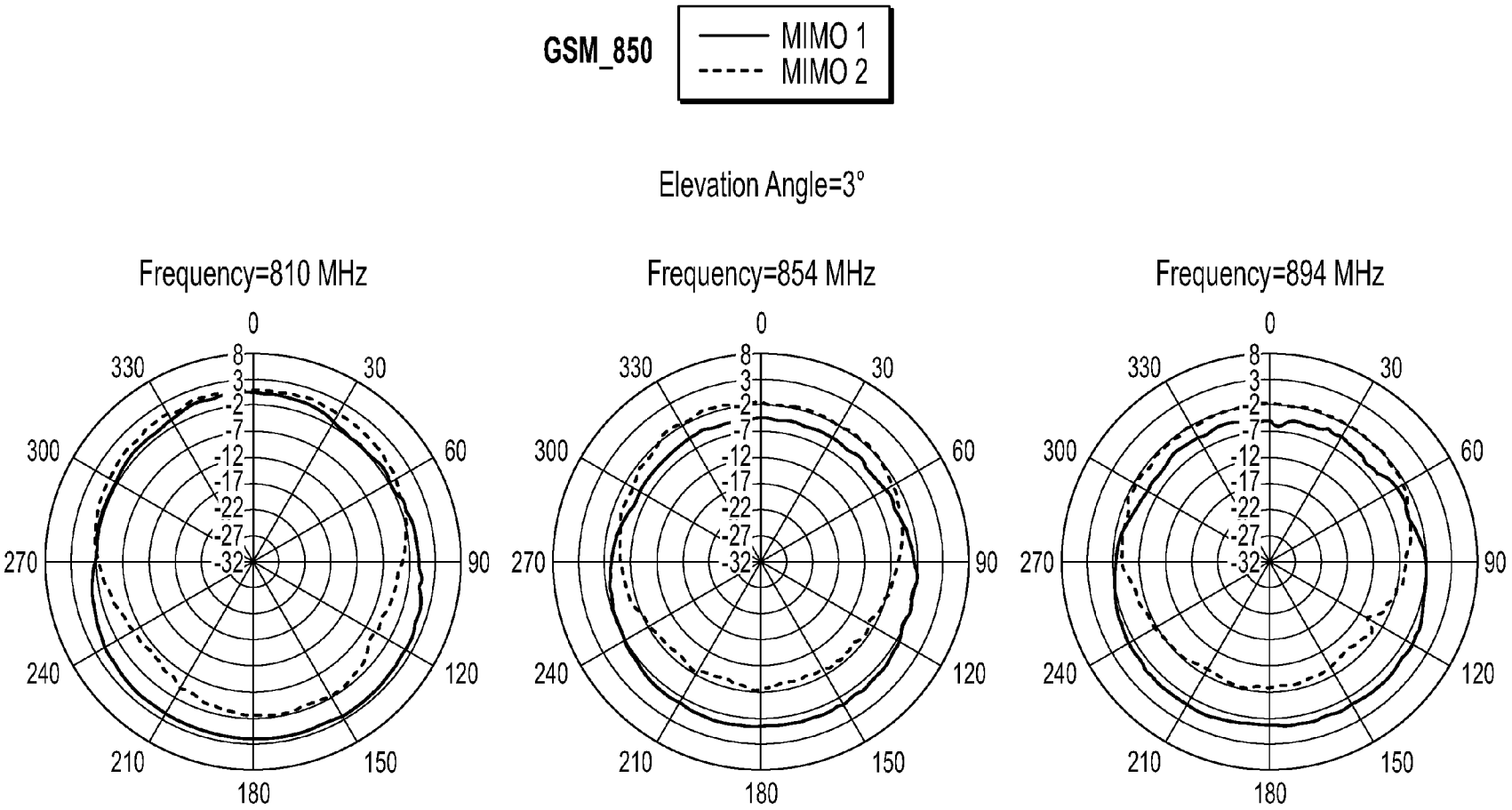
Figure 20:
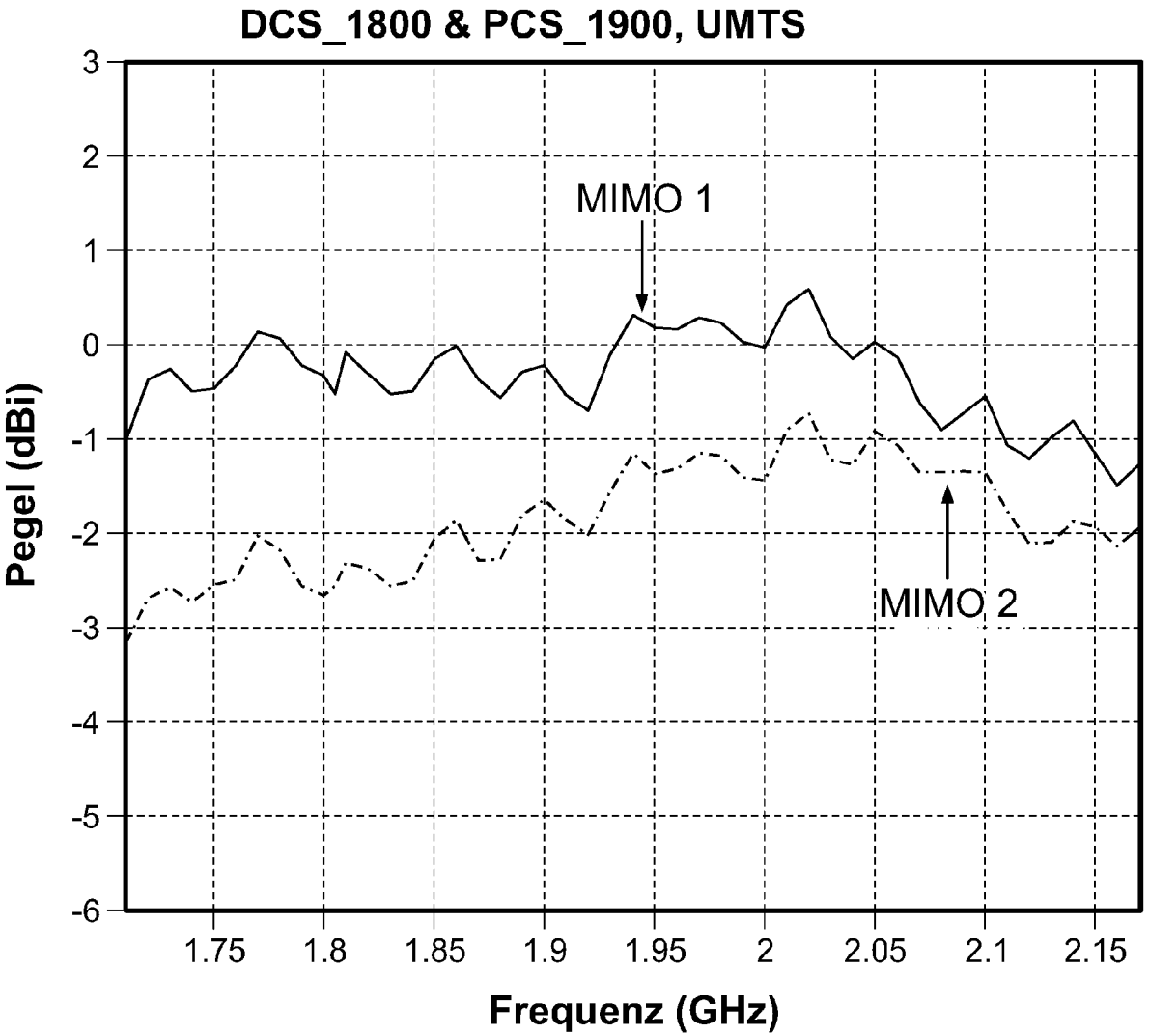
Figure 21:
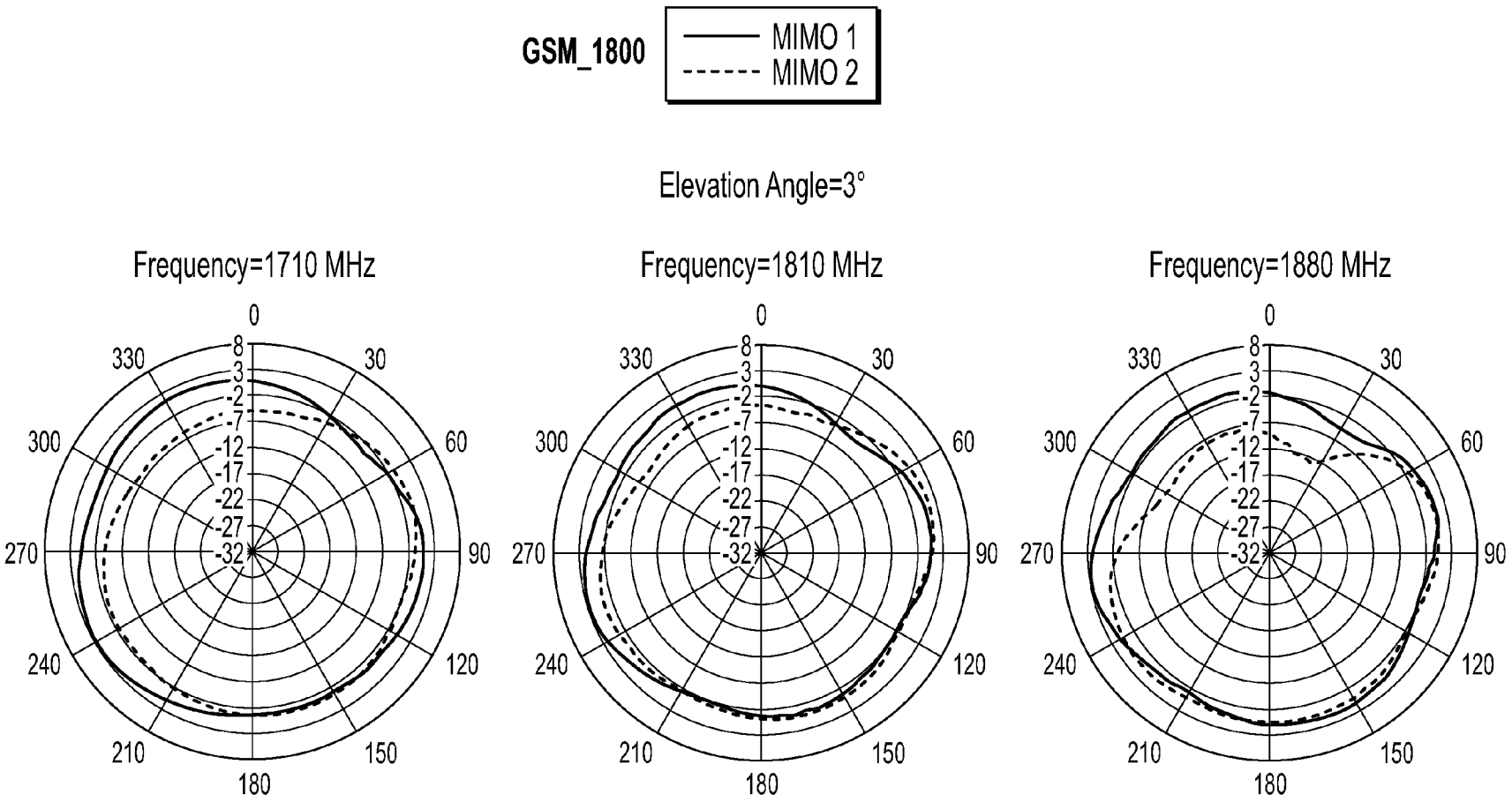
Figure 22:
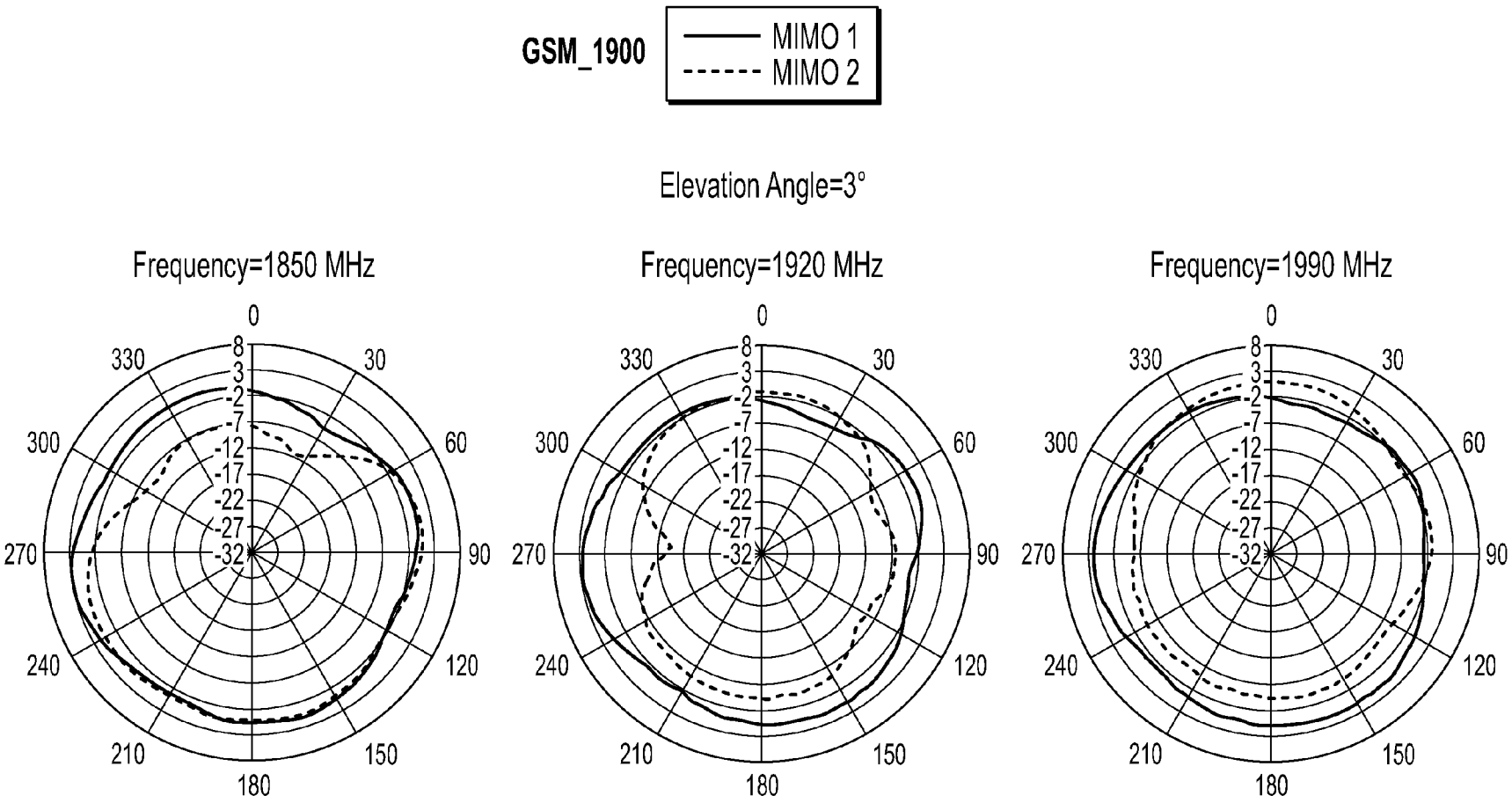
Figure 23:
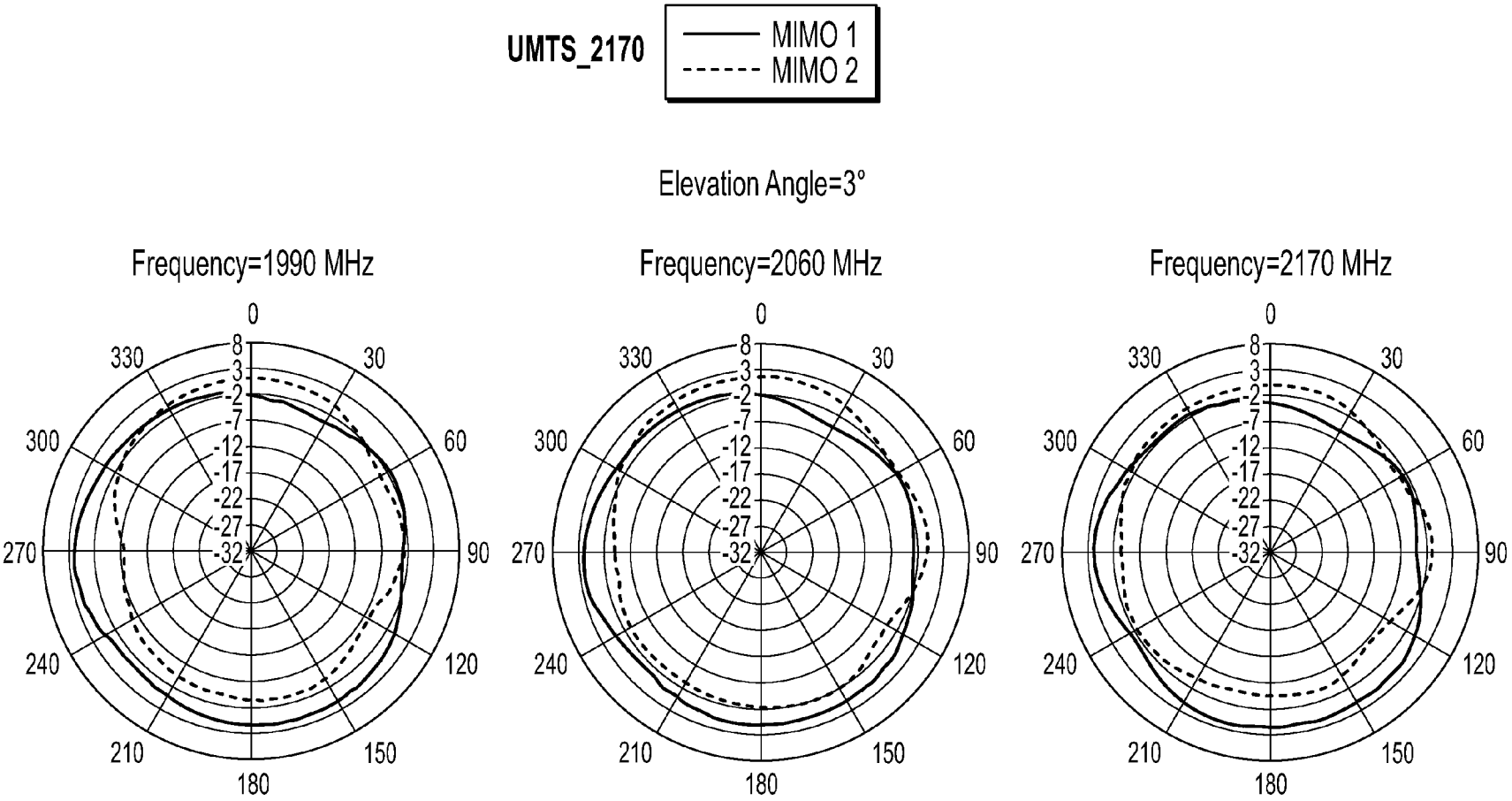
Figure 24:
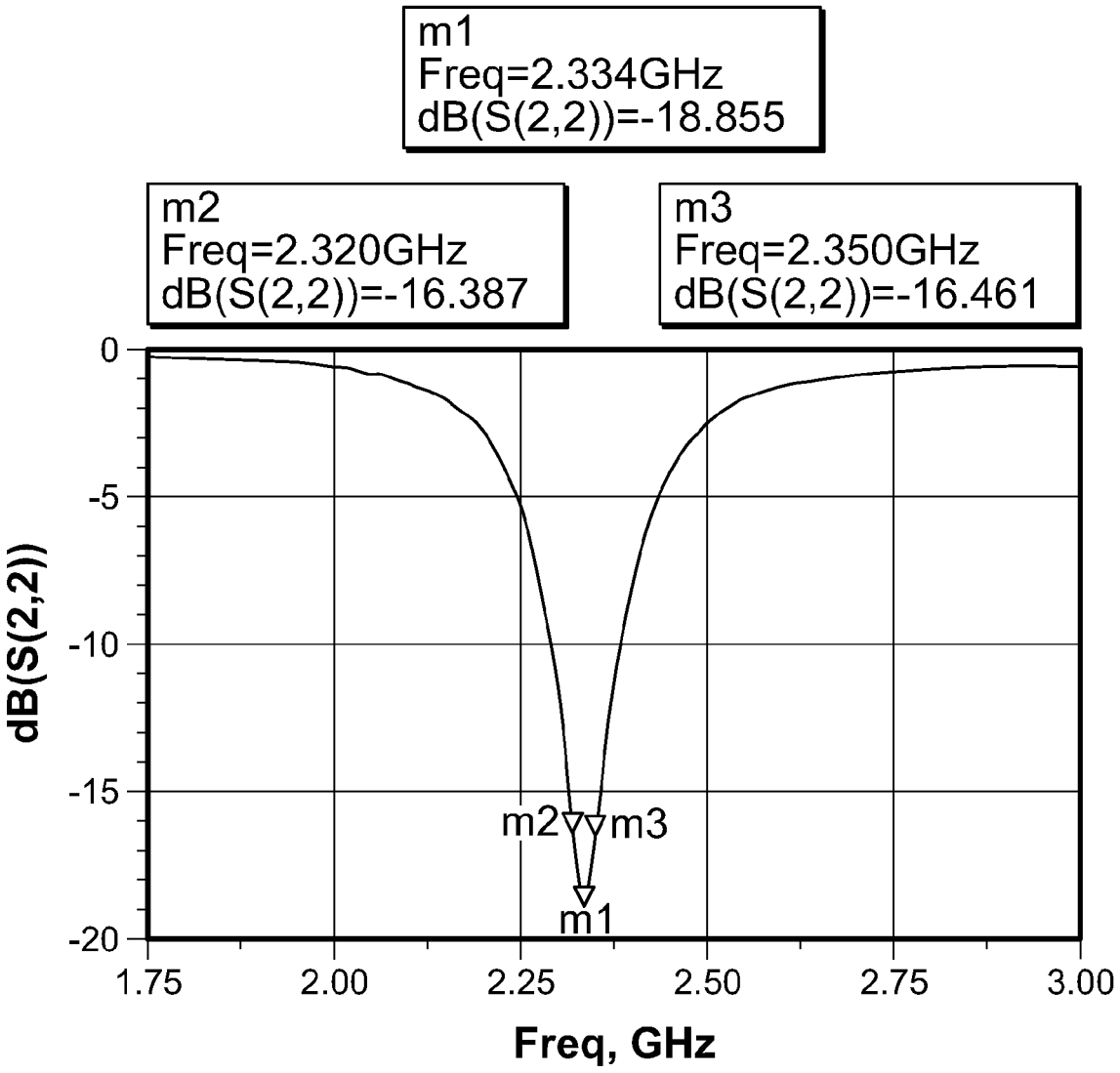
Figure 25:
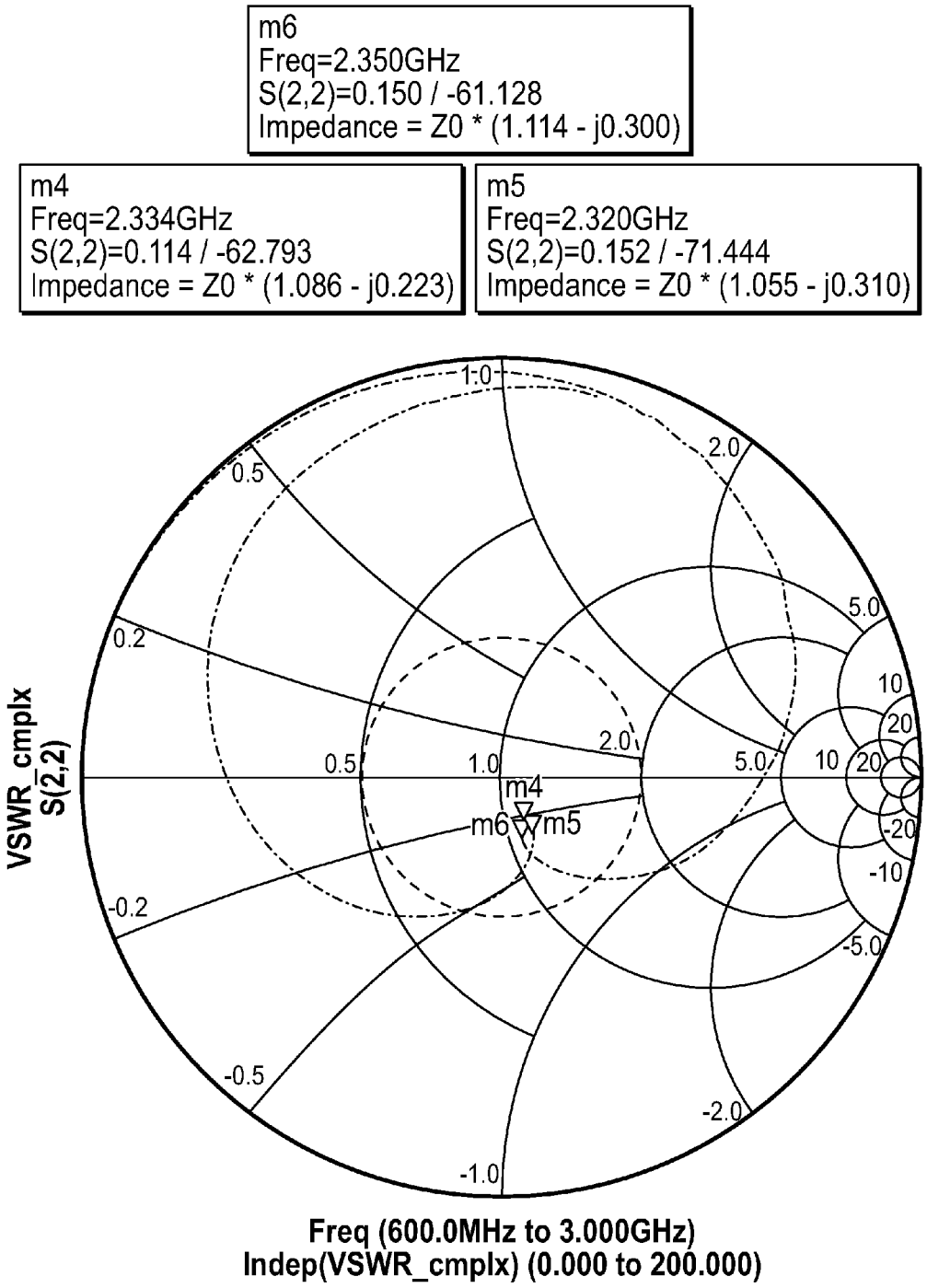
Figure 26:
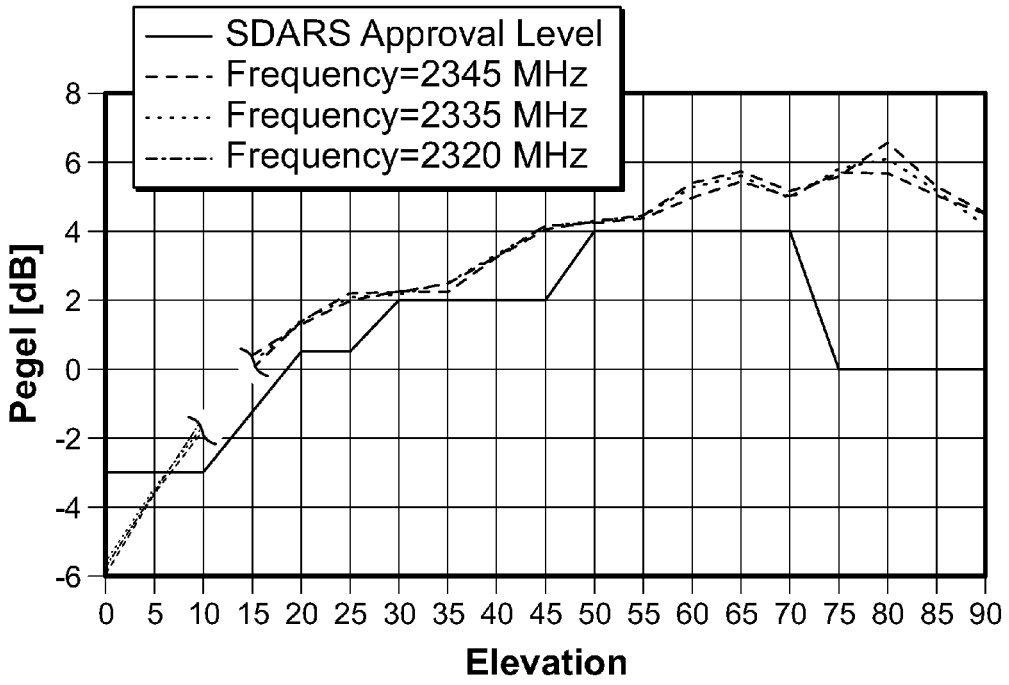
Figure 27:
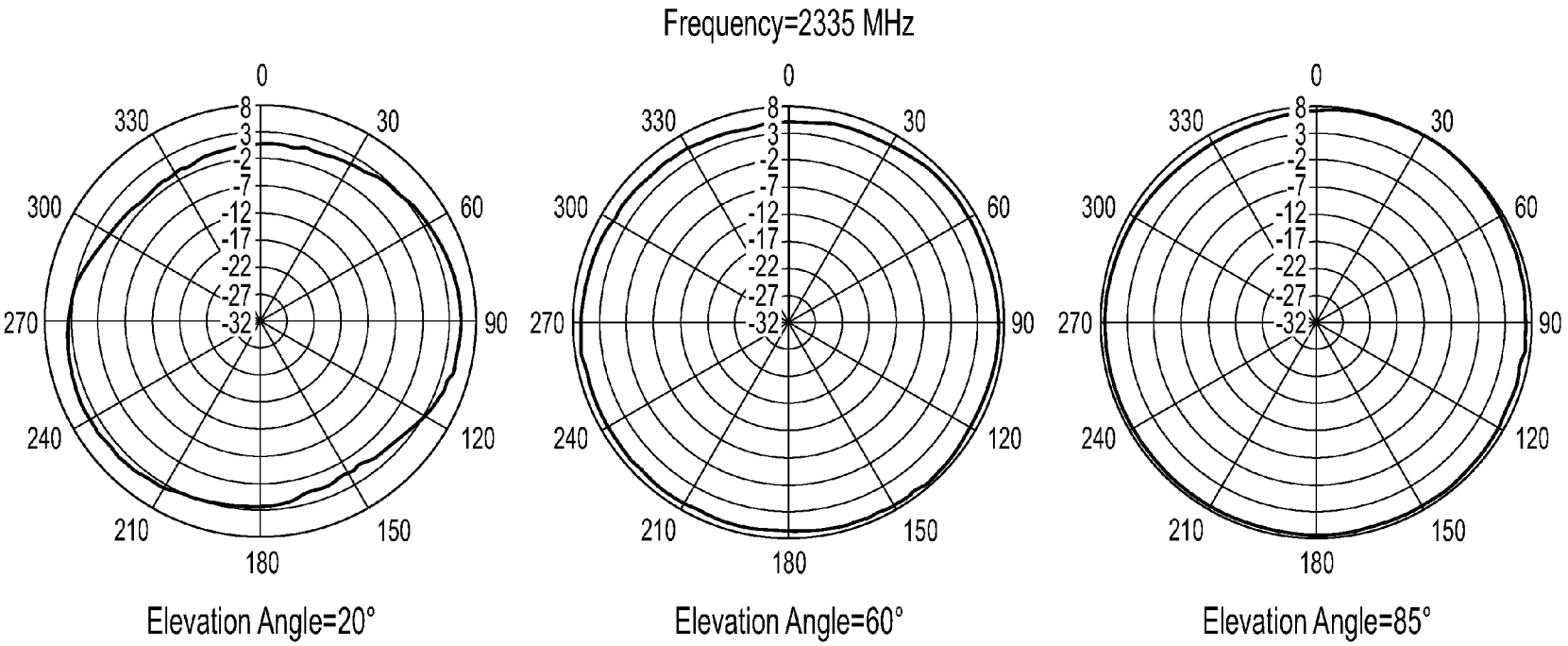

FIG. 17 includes radiation patterns for the first and second MIMO antennas respectively shown in FIGS. 3 and 4 measured at an elevation angle of 3 degrees and at LTE 700 frequencies of 740 Megahertz (MHz), 760 MHz, and 800 MHz;

FIG. 18 is a level diagram in decibels-isotropic (dBi) versus GSM 850 frequencies in gigahertz measured for the first and second MIMO antennas respectively shown in FIGS. 3 and 4;

FIG. 19 includes radiation patterns for the first and second MIMO antennas respectively shown in FIGS. 3 and 4 measured at an elevation angle of 3 degrees and at GSM 850 frequencies of 810 MHz, 854 MHz, and 894 MHz;

FIG. 20 is a level diagram in decibels-isotropic (dBi) versus DCS 1800 & PCS 1900, UMTS frequencies in gigahertz for the first and second MIMO antennas respectively shown in FIGS. 3 and 4;

FIG. 21 includes radiation patterns for the first and second MIMO antennas respectively shown in FIGS. 3 and 4 measured at an elevation angle of 3 degrees and at GSM 1800 frequencies of 1710 MHz, 1810 MHz, and 1880 MHz;

FIG. 22 includes radiation patterns for the first and second MIMO antennas respectively shown in FIGS. 3 and 4 measured at an elevation angle of 3 degrees and at GSM 1900 frequencies of 1850 MHz, 1920 MHz, and 1990 MHz;

FIG. 23 includes radiation patterns for the first and second MIMO antennas respectively shown in FIGS. 3 and 4 measured at an elevation angle of 3 degrees and at UMTS 2170 frequencies of 1990 MHz, 2060 MHz, and 2170 MHz;

FIG. 24 is a line graph of measured reflection or matching S22 in decibels versus SDARS (satellite digital audio radio services) frequencies in gigahertz for the second MIMO antenna shown in FIG. 4;

FIG. 25 is a graph of voltage standing wave ratio (VSWR) S22 in decibels versus SDARS frequencies in gigahertz measured for the second MIMO antenna shown in FIG. 4;

FIG. 26 is a level diagram in decibels-isotropic (dBi) versus elevation angle in degrees at SDARS frequencies of 2320 MHz, 2335 MHz, and 2345 MHz measured for the first MIMO antenna shown in FIG. 3; and FIG. 27 includes radiation patterns for the second MIMO antenna shown in FIG. 4 measured at an SDARS frequency of 2335 MHz and at elevation angles of 20 degrees, 60 degrees, and 85 degrees.

Corresponding reference numerals indicate corresponding parts throughout the several views of the drawings.

DETAILED DESCRIPTION

Example embodiments will now be described more fully with reference to the accompanying drawings.

The inventors hereof recognized a need for MIMO (Multiple Input Multiple Output) antenna assemblies or systems operable with different services, such as LTE (Long Term Evolution) which is cellular phone system 4th generation, Wi-Fi, and DSRC (Dedicated Short Range Communication) which is used as Car2X. One of the challenges for the inventors was to design antenna elements that fulfill the gain, matching, and mutual de-coupling between the antenna elements in a very compact size. With a small compact size, the inventors' realized that mutual de-coupling would be an important parameter when trying to achieve the best overall system performance for systems like LTE.

After recognizing the above, the inventors developed and disclose herein exemplary embodiments of multiband MIMO vehicular antenna assemblies or systems. In exemplary embodiments, the antenna assembly includes 3D conformal antennas on an inner radome, antenna carrier, cover, or housing (e.g., FIGS. 2, 3, 4, 9, 8, and 12, etc.). The antenna assembly also includes an outer radome, housing, or cover (e.g., FIGS. 1 and 2, etc.). The outer radome is positioned over the inner radome such that the inner radome is covered by the outer radome. The outer radome may be configured (e.g., painted, etc.) to match a color of the vehicle on which it will be installed.

Figure 11:
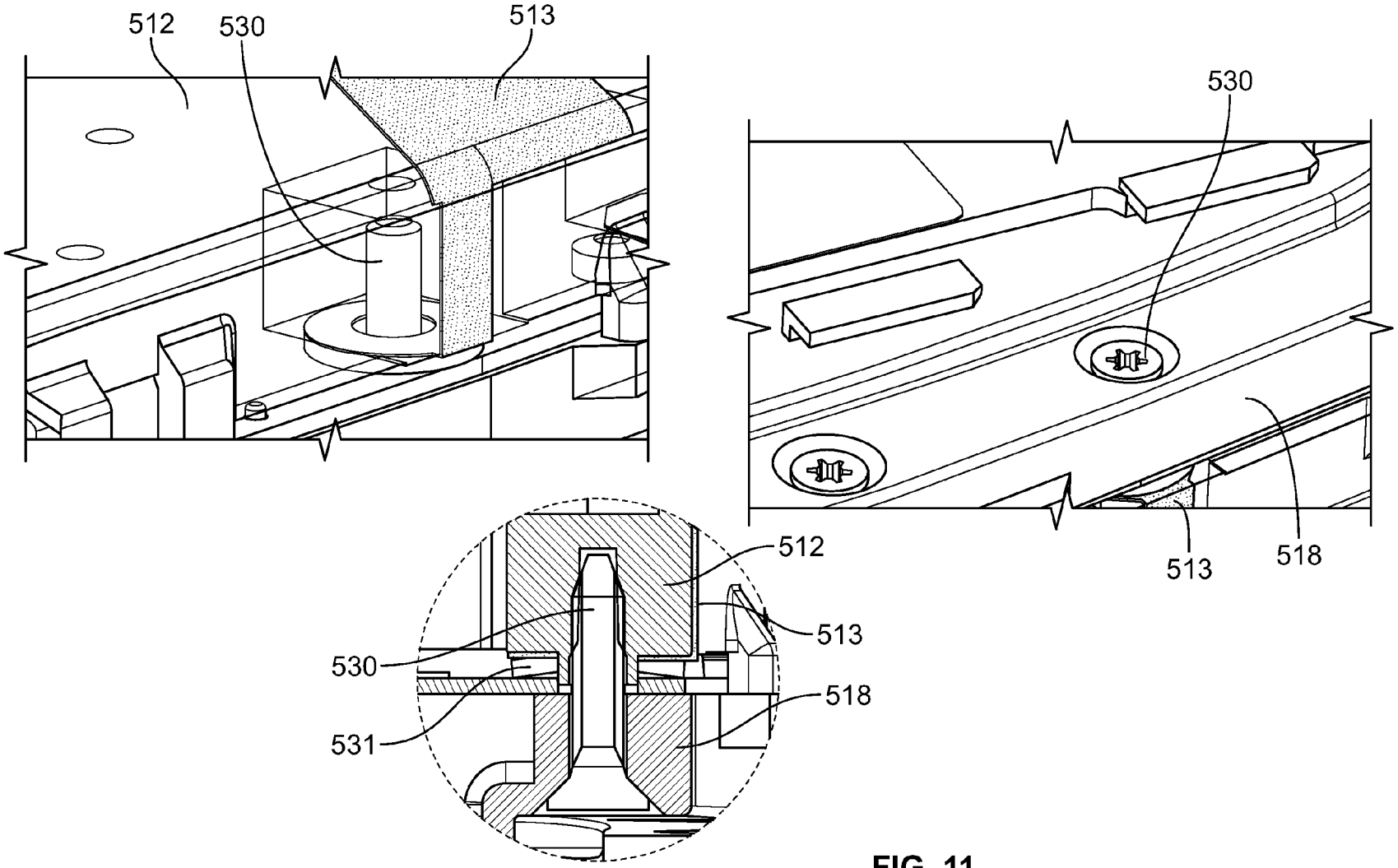
FIG. 11 illustrates an exemplary manner by which an inner radome, cover, or antenna carrier may be coupled to a chassis of an antenna assembly using screws according to an exemplary embodiment.

The outer radome may be configured so as to seal the entire antenna assembly against the ingress of water, dust, etc. In some exemplary embodiments, the inner radome (e.g., FIG. 11, etc.) may be configured to be water sealed, and the outer radome may be clipped in or onto the antenna assembly. For example, FIG. 11 illustrates an exemplary embodiment in which a water sealed inner cover is screwed on a chassis.

The 3D conformal antenna elements may be provided on the outer surface of the inner radome or antenna carrier in various ways. By way of example, an exemplary embodiment includes 3D conformal antenna elements that comprise flex film antennas. The flex film antennas are coupled (e.g., adhesively attached, etc.) to the inner radome. The flex film antennas are flexed, bent, curved, or otherwise shaped in conformance with a shape or contour of the outer surface of the inner radome. The flex film antennas thus generally follow the shape or contour of the corresponding portion of the inner radome along which they are positioned. In other exemplary embodiments, a two shot molding process, selective plating process, and/or laser direct structuring (LDS) process may be used to provide 3D conformal antennas on an inner radome or antenna carrier in exemplary embodiments.

In another exemplary embodiment, 3D conformal antennas may be provided on an inner radome or antenna carrier by a process disclosed in U.S. Pat. No. 7,804,450, the contents of which is incorporated herein by reference. For example, the inner radome and 3D antenna elements may be made by forming (e.g., two shot molding, etc.) the inner radome from a first type of plastic and a second type of plastic. The first or second type of plastic comprises a laser direct structuring material, and the other one comprises a non-platable plastic. The laser direct structuring material is painted with a laser to activate a portion of the laser direct structuring material. The activated portion of the laser direct structuring material is plated to thereby form 3D antenna elements that reside on the activated portion of the laser direct structuring material.

The 3D conformal antennas may be spaced apart from the inner surface of the outer radome and the chassis of the antenna assembly. The 3D conformal antennas are located within an interior enclosure or cavity collectively defined between the outer radome and the chassis. The 3D conformal antennas may also be referred to as cavity antennas in some exemplary embodiments.

The 3D conformal antenna elements may comprise a wide range of antenna types. In exemplary embodiments, the 3D conformal antenna elements comprise broadband folded 3D monopole and folded LIFA (Linear Inverted F Antenna). Both elements follow and conform to the shape of the inner radome or cover. For example, the folded 3D monopole and folded LIFA may be located along outer surfaces of back and front portions of the inner radome. In this example, the folded 3D monopole and folded LIFA may be operable as MIMO antennas.

The inner radome or cover carries or supports the antenna elements. The inner radome may be designed in a way so that the 3D conformal antenna elements bring the best or improved performance. But the shape and size of the inner radome is limited by the shape and size of the outer radome or cover because the inner radome must fit within or under the outer radome. The shape and size of the outer radome is generally a matter of design (e.g., aerodynamics, other considerations, etc.) and aesthetics.

Vehicular antenna assemblies are typically compact and small in size. Because of the compact size, the inventors realized that the antenna elements having a three dimensional shape were preferred in order to meet the required gain, matching, and mutual de-coupling between the antenna elements in compact size antenna modules. In exemplary embodiments, the inner radome or antenna carrier may be non-flat and extend in three dimensions. Three-dimensional electrically-conductive material structure may be provided on a curved surface of the antenna carrier or on two planar surfaces of the antenna carrier that are provided at an angle to each other (e.g., acute, obtuse, or right angle). In an exemplary embodiment, 3D antenna elements are made by LDS technology on LDS material. The LDS material may be cut in a way such that the rest of the inner cover, which may be built by conventional non-LDS material, follows the line of the outer cover or radome.

Figure 9:
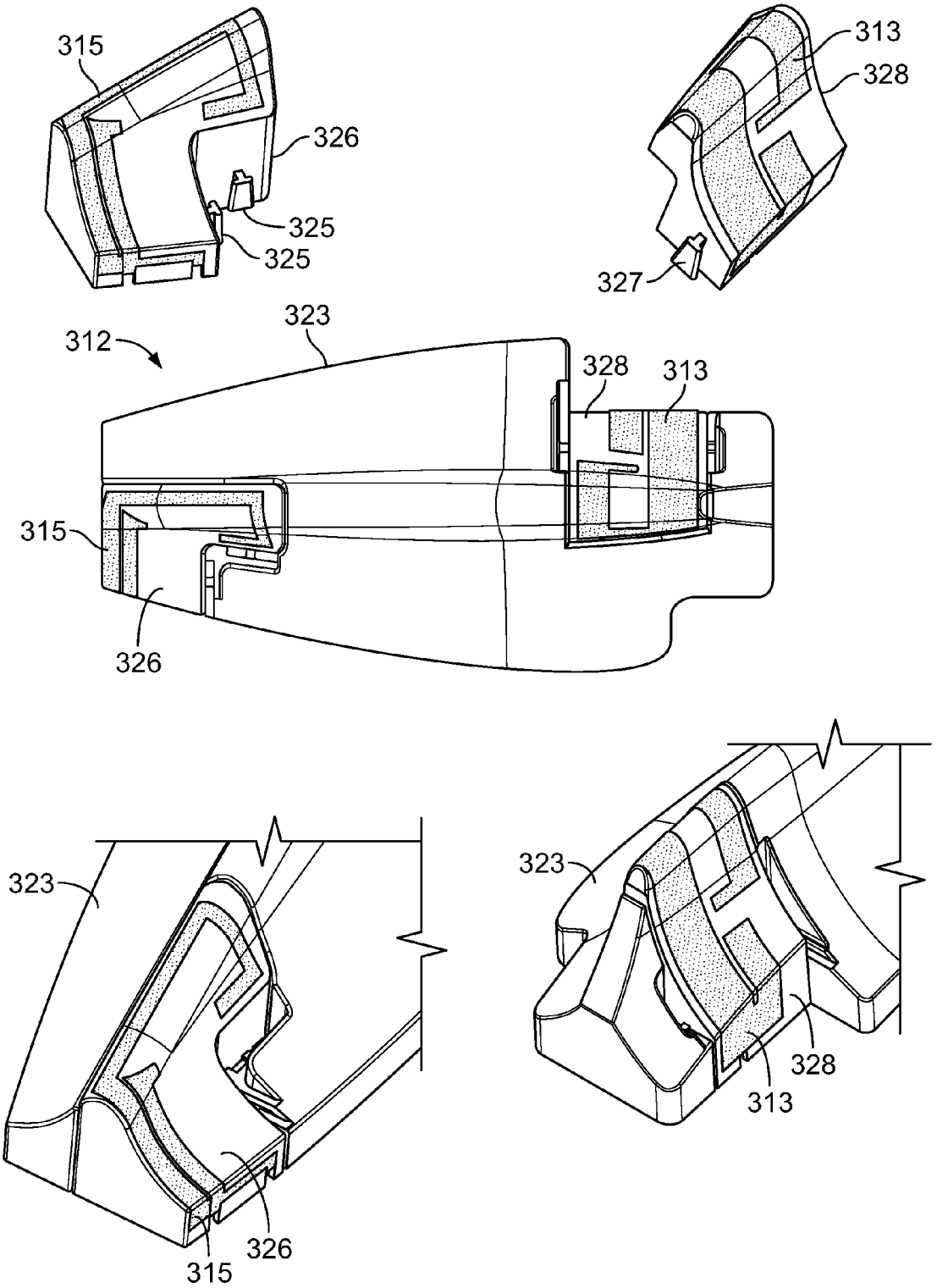
FIG. 9 is a perspective view of a multi-piece inner radome, cover, or antenna carrier according to another exemplary embodiment that includes first and second MIMO antennas along outer surfaces of front and back pieces that are attachable to the middle or inner piece of the inner radome.

Some exemplary embodiments include a multi-piece inner cover or radome (e.g., FIG. 9, etc.). The multiple pieces of the inner cover may be coupled to the antenna chassis, for example, by clips, screws, other mechanical fasteners, dovetail joints, etc. A printed circuit board (PCB) may be coupled to the antenna chassis, e.g., by mechanical fasteners, etc. The PCB may include the electronics necessary for matching, amplifying, and signal processing.

Some exemplary embodiments include molded interconnect devices (MID) (broadly, contact areas). The contact areas (e.g., FIGS. 5, 7, 8, 10, and 11, etc.) electrically connect the antenna elements on the inner radome to corresponding electrically conductive portions (e.g., traces, etc.) of a PCB. The contact areas may be built as pads. The contact areas may be electrically connected to electrically-conductive portions (e.g., pads, traces, etc.) of the PCB by flexible electrically-conductive material (e.g., silver/copper silicone elastomer, etc.). A molded interconnect device (MID) may comprise an injection-molded thermoplastic with integrated electronic circuit traces. The MID may comprise thermoplastic and circuitry combined into a single part through selective metallization.

Figure 1:
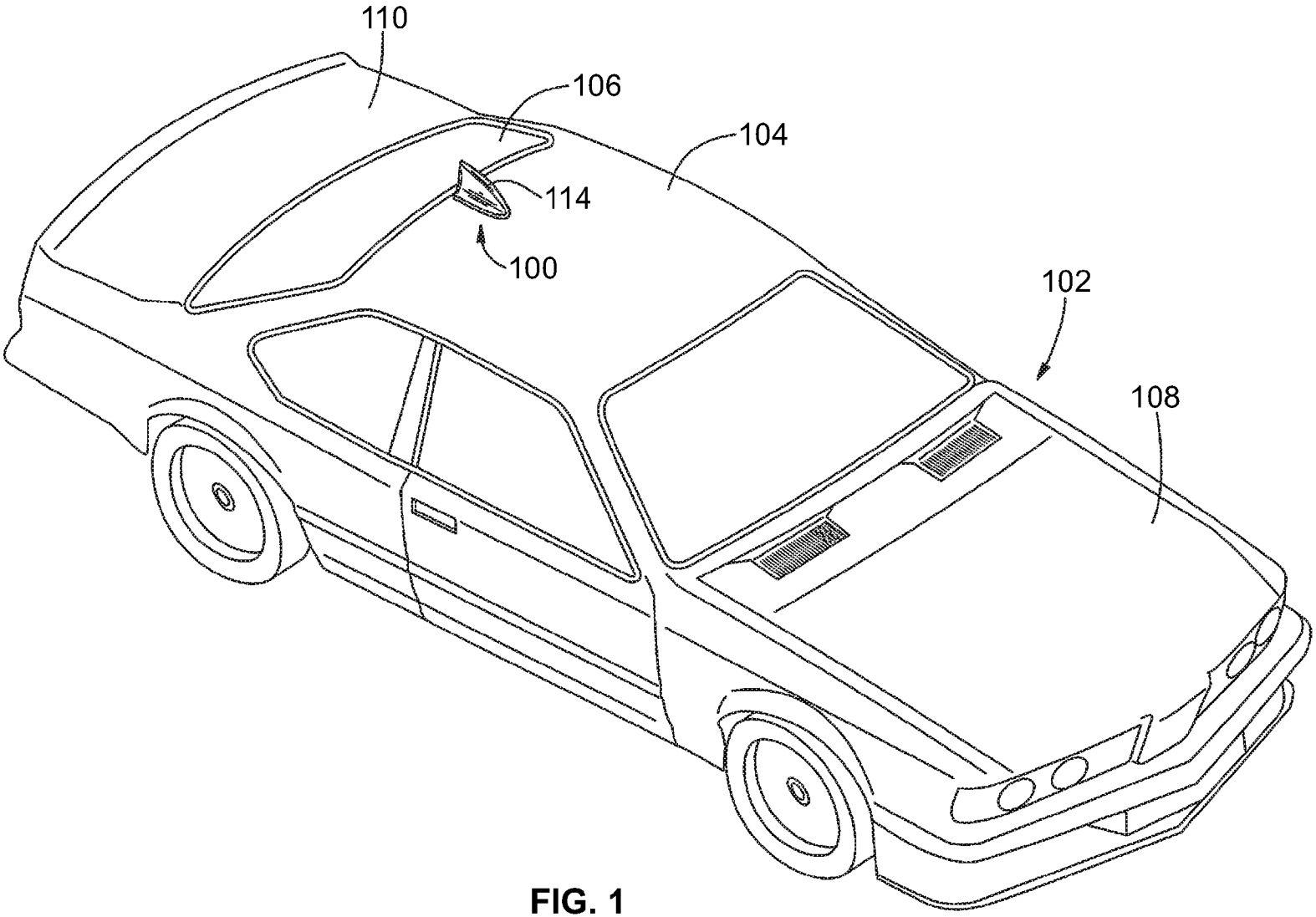
FIG. 1 is a perspective view of an example embodiment of an antenna assembly including at least one or more aspects of the present disclosure shown installed to a roof of a car.

With reference now to the drawings, FIG. 1 illustrates an example embodiment of an antenna assembly 100 including at least one or more aspects of the present disclosure. As shown in FIG. 1, the antenna assembly 100 may be installed on a car 102 (broadly, a mobile platform). In particular, the antenna assembly 100 is shown mounted on a roof 104 of the car 102 toward a rear window 106 of the car 102 and along a longitudinal centerline of the roof 104. Here, the roof 104 of the car 102 acts as a ground plane for the antenna assembly 100. The antenna assembly 100 could, however, be mounted differently within the scope of the present disclosure. For example, the antenna assembly 100 could be mounted on a hood 108 or a trunk 110 of the car 102, etc. In addition, the antenna assembly 100 could be installed to a mobile platform other than the car 102, for example, a truck, a bus, a recreational vehicle, a boat, a vehicle without a motor, etc., within the scope of the present disclosure. U.S. Pat. No. 7,492,319 discloses example installations of antenna assemblies to vehicle bodies, the entire disclosure of which is incorporated herein by reference.

Figure 2:
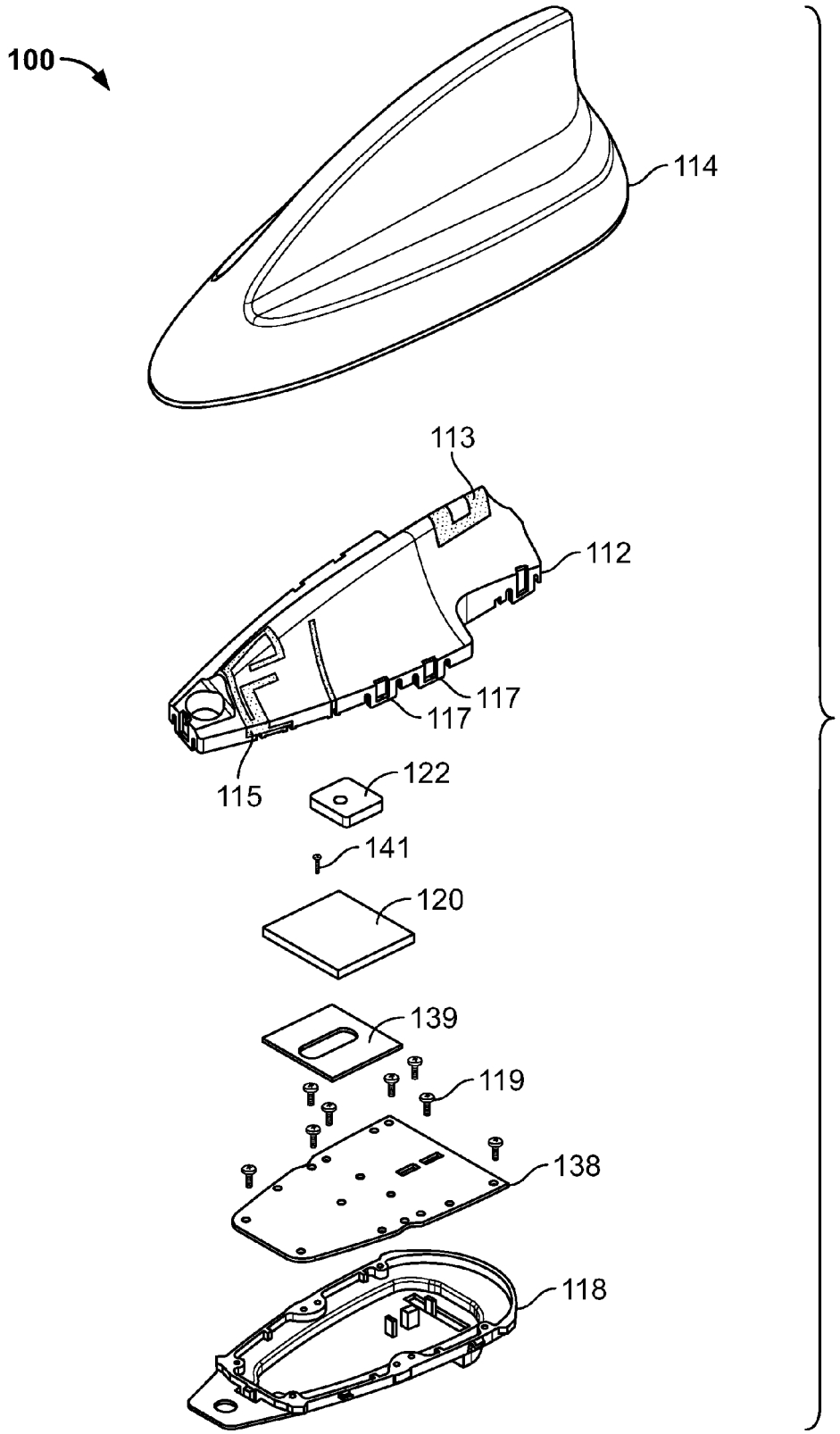
FIG. 2 is an exploded perspective view of the antenna assembly shown in FIG. 1.

As shown in FIG. 2, the antenna assembly 100 includes an outer cover (or radome) 114. The outer radome 114 helps protect components of the antenna assembly 100 that are under the outer radome 114 and enclosed within an interior collectively defined between the outer radome 114 and chassis 118 (or base). For example, the outer radome 114 may help protect an inner radome 112, antenna elements 113, 115 on the inner radome 112, first and second antennas 120, 122, and PCB 138.

The cover 114 can substantially seal the components of the antenna assembly 100 within the cover 114 thereby protecting the components against ingress of contaminants (e.g., dust, moisture, etc.) into an interior enclosure of the cover 114. In addition, the cover 114 can provide an aesthetically pleasing appearance to the antenna assembly 100, and can be configured (e.g., sized, shaped, constructed, etc.) with an aerodynamic configuration. In the illustrated embodiment, for example, the cover 114 has an aesthetically pleasing, aerodynamic shark-fin configuration. In other example embodiments, however, antenna assemblies may include covers having configurations different than illustrated herein, for example, having configurations other than shark-fin configurations, etc. The cover 114 may also be formed from a wide range of materials, such as, for example, polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), etc. within the scope of the present disclosure.

The PCB 138 can include any suitable PCB within the scope of the present disclosure including, for example, a double-sided PCB, etc. The illustrated PCB 138 is fastened to the chassis 118 by mechanical fasteners 119. The first antenna 120 is attached to the PCB 138 using adhesive tape 139. The second antenna 122 is stacked on top of the first antenna 120. Other means for coupling the PCB 138 to the chassis 118 and/or for coupling the antenna 120 to the first PCB 138 may be used within the scope of the present disclosure. In addition, the first and second antennas 120, 122 may be positioned side-by-side or adjacent on the PCB 138 instead of a stacked patch arrangement.

The outer radome 114 is configured to fit over the inner radome 112, first and second antennas 120 and 122, and PCB 138. The outer radome 114 is configured to be secured to the chassis 118. And, the chassis 118 is configured to couple to the roof 104 of the car 102 for installing the antenna assembly 100 to the car 102 (FIG. 1). The outer radome 114 may secure to the chassis 118 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc. Alternatively, the outer radome 114 may connect directly to the roof 104 of the car 102 within the scope of the present disclosure.

The inner radome 112 is configured to fit over the first and second antennas 120 and 122 and PCB 138. The inner radome 112 is configured to be secured to the chassis 118. The inner radome 112 may secure to the chassis 118 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc. In the illustrated embodiment shown in FIG. 2, the inner radome 112 includes latching or snap clip members 117 to allow the inner radome 112 to be latched or snap clipped onto the chassis 118.

The chassis 118 may be formed from materials similar to those used to form the cover 114. For example, the chassis 118 may be injection molded from polymer. Alternatively, the chassis 118 may be formed from steel, zinc, or other material (including composites) by a suitable forming process, for example, a die cast process, etc., within the scope of the present disclosure. U.S. Pat. No. 7,429,958 (Lindackers et al.) and U.S. Pat. No. 7,755,551 (Lindackers et al.) disclose example couplings between covers and chassis of antenna assemblies.

While not shown, a sealing member (e.g., an O-ring, a resiliently compressible elastomeric or foam gasket, etc.) may be provided between the chassis 118 and the roof 104 of the car 102 for substantially sealing the chassis 118 against the roof 104. A sealing member may also, or alternatively, be provided between the cover or outer radome 114 of the antenna assembly 100 and the chassis 118 for substantially sealing the cover 114 against the chassis 118.

The first antenna 120 of the illustrated antenna assembly 100 is a patch antenna configured for use with SDARS (e.g., configured for receiving/transmitting desired SDARS signals, etc.). This SDARS antenna 120 is coupled to the PCB 138 via adhesive tape 139. The SDARS antenna 120 is electrically coupled to the PCB 138 by an electrical connector 141, e.g., pin, etc., as desired and fastened thereto by a mechanical fastener. The SDARS antenna 120 may be operable at one or more desired frequencies including, for example, frequencies ranging between about 2,320 MHz and about 2,345 MHz, etc. The SDARS antenna 120 may also be tuned as desired for operation at desired frequency bands by, for example, changing dielectric materials, changing sizes of metal plating, etc., used in connection with the SDARS antenna 120, etc.

The second antenna 122 is a patch antenna configured for use with global positioning systems (GPS) (e.g., configured for receiving/transmitting desired GPS signals, etc.). This GPS antenna 122 is stacked on top of the SDARS antenna 120. Alternatively, the GPS antenna 122 could be located adjacent or side-by-side with the SDARS antenna 120. The GPS antenna 122 is electrically coupled to the PCB 138, e.g., by a feed pin, etc. The GPS antenna 122 may be operable at one or more desired frequencies including, for example, frequencies ranging between about 1,574 MHz and about 1,576 MHz, etc. And, the GPS antenna 122 may also be tuned as desired for operation at desired frequency bands by, for example, changing dielectric materials, changing sizes of metal plating, etc., used in connection with the GPS antenna 122, etc.

FIGS. 3 and 4 respectively show the MIMO antenna elements 113 and 115 extending along corresponding outer surface portions of the inner radome 112. The antenna elements 113, 115 are shaped or contoured in conformance with a shape or contour of the outer surface of the inner radome 112. The antenna elements 113, 115 generally follow the shape or contour of the respective back and front portions of the inner radome 112 along which they are positioned. The antenna elements 113, 115 on the outer surface of the inner radome or antenna carrier 112 may be made using various ways. By way of example, the antenna elements 113, 115 may comprise flex film antennas coupled (e.g., adhesively attached, etc.) to the inner radome 112. In other exemplary embodiments, a two shot molding process, selective plating process, and/or laser direct structuring (LDS) process may be used to provide the antenna elements 113, 115 on the inner radome or antenna carrier 112.

Figure 6:
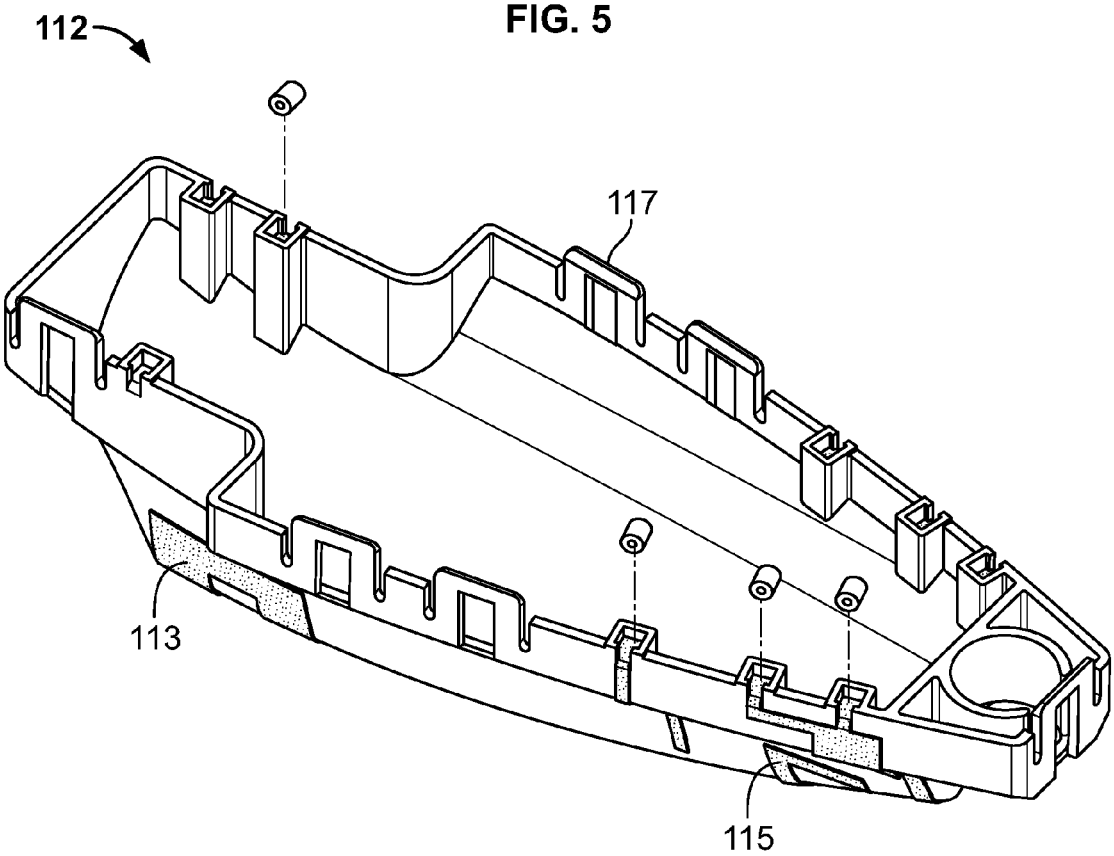
FIG. 6 is an exploded perspective view showing four contact members (e.g., cylindrical, tubular, hollow silver/copper silicone contact members, flexible electrically-conductive silicone elastomer, etc.) aligned for positioning within corresponding openings of the inner radome.
Figure 7:
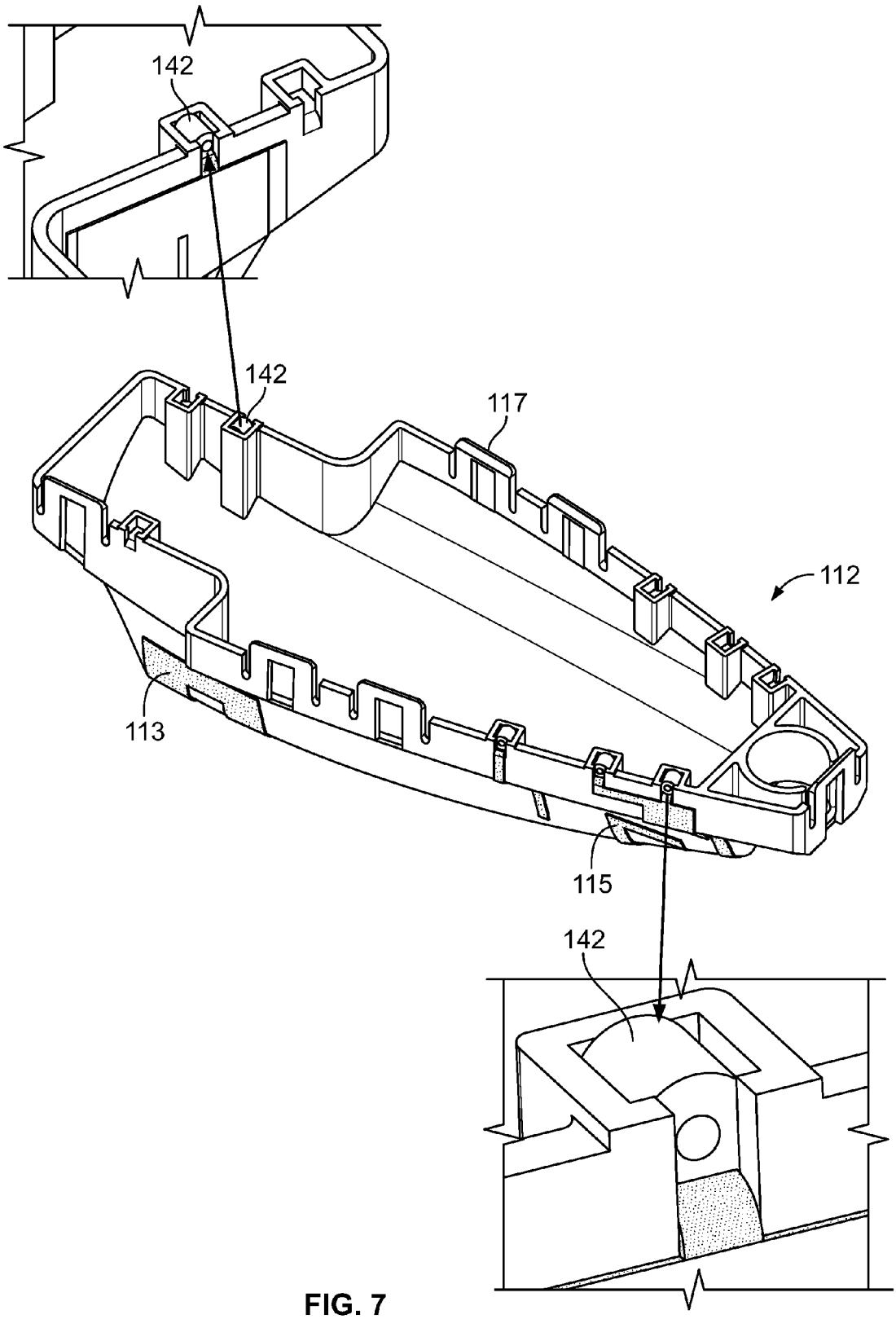
FIG. 7 is a perspective view of the inner radome shown in FIG. 6 after the contact members have been positioned within the corresponding openings.

As shown in FIG. 6, there are molded interconnect devices (MID) (broadly, contact areas) 142 along the lower portion of the inner radome 112. The contact areas 142 are operable for electrically connecting the antenna elements 113, 115 on the inner radome 112 to corresponding electrically conductive portions (e.g., traces, etc.) of the PCB 138. The contact areas 142 may be built as pads. In this example, the contact areas 142 comprise flexible electrically-conductive members having a hollow profile and made of silver/copper silicone elastomer, etc.

The antenna elements 113, 115 may be spaced apart from the inner surface of the outer radome 114 and the chassis 118. The antenna elements 113, 115 are located within an interior enclosure or cavity collectively defined between the outer radome 114 and the chassis 118. The antenna elements 113, 115 may comprise a wide range of antenna types. For example, the antenna elements 113, 115 may comprise broadband folded 3D monopole and folded LIFA (Linear Inverted F Antenna).

Figure 8:
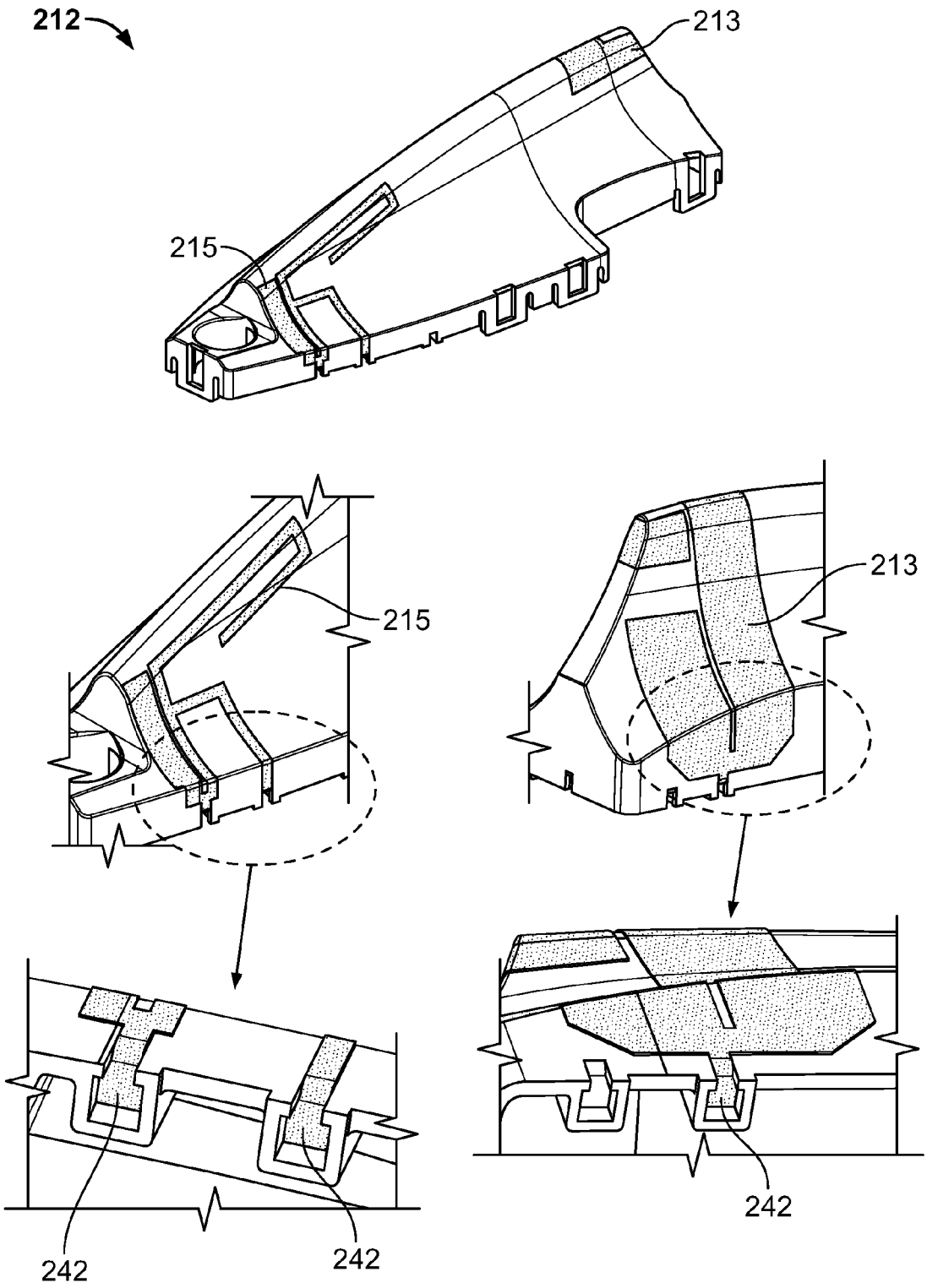
FIG. 8 is a perspective view of an inner radome, cover, or antenna carrier according to an exemplary embodiment that also includes first and second MIMO antennas along outer surfaces of the inner radome.

FIG. 8 illustrates an inner radome, cover, or antenna carrier 212 that may be used in exemplary embodiments of the present disclosure. For example, the inner radome 212 may be used in the antenna assembly 100 instead of the inner radome 112.

As shown in FIG. 8, the inner radome 212 includes first and second antennas 213, 215. The antenna elements 213 and 215 extend along corresponding outer surface portions of the inner radome 212. The antenna elements 213, 215 are shaped or contoured in conformance with a shape or contour of the outer surface of the inner radome 212. The antenna elements 213, 215 generally follow the shape or contour of the respective back and front portions of the inner radome 212 along which they are positioned. By way of example, the antenna elements 213, 215 may comprise flex film antennas coupled (e.g., adhesively attached, etc.) to the inner radome 212. In other exemplary embodiments, a two shot molding process, selective plating process, and/or laser direct structuring (LDS) process may be used to provide the antenna elements 213, 215 on the inner radome or antenna carrier 212.

There are molded interconnect devices (MID) (broadly, contact areas) 242 along the lower portion of the inner radome 212. The contact areas 242 are operable for electrically connecting the antenna elements 213, 215 on the inner radome 212 to corresponding electrically conductive portions (e.g., traces, etc.) of a PCB. The contact areas 242 may be built as pads. The contact areas 242 may comprise flexible electrically-conductive members having a hollow profile (e.g., FIG. 7, etc.) and made of silver/copper silicone elastomer, etc.

FIG. 9 illustrates a multi-piece inner radome, cover, or antenna carrier 312 that may be used in exemplary embodiments of the present disclosure. For example, the multi-piece inner radome 312 may be used in the antenna assembly 100 instead of the inner radome 112.

As shown in FIG. 9, the inner radome 312 includes a middle or inner piece 323 and front and back pieces 326, 328 attachable to the middle piece 323. Accordingly, the inner radome 312 in this example includes three pieces 323, 326, and 328.

The front and back pieces 326 and 328 may be connected or attached to the middle piece 323 using various means or methods, such as by clips, screws, other mechanical fasteners, etc. In the illustrated embodiment, the front and back pieces 326 and 328 include protruding portions 325, 327 (e.g., dovetail shaped members, etc.) that are engageable within corresponding slots or channels in the middle piece 323.

First and second antennas 313, 315 are along outer surfaces of respective back and front pieces 328 and 326. The antenna elements 313, 315 are shaped or contoured in conformance with a shape or contour of the outer surfaces of the respective back and front pieces 328, 326. The antenna elements 313, 315 generally follow the shape or contour of the respective back and front pieces 328, 326 of the inner radome 312 along which they are positioned. By way of example, the antenna elements 313, 315 may comprise flex film antennas coupled (e.g., adhesively attached, etc.) to the respective back and front pieces 328, 326. In other exemplary embodiments, a two shot molding process, selective plating process, and/or laser direct structuring (LDS) process may be used to provide the antenna elements 313, 315 on the inner radome or antenna carrier 312.

Figure 10:
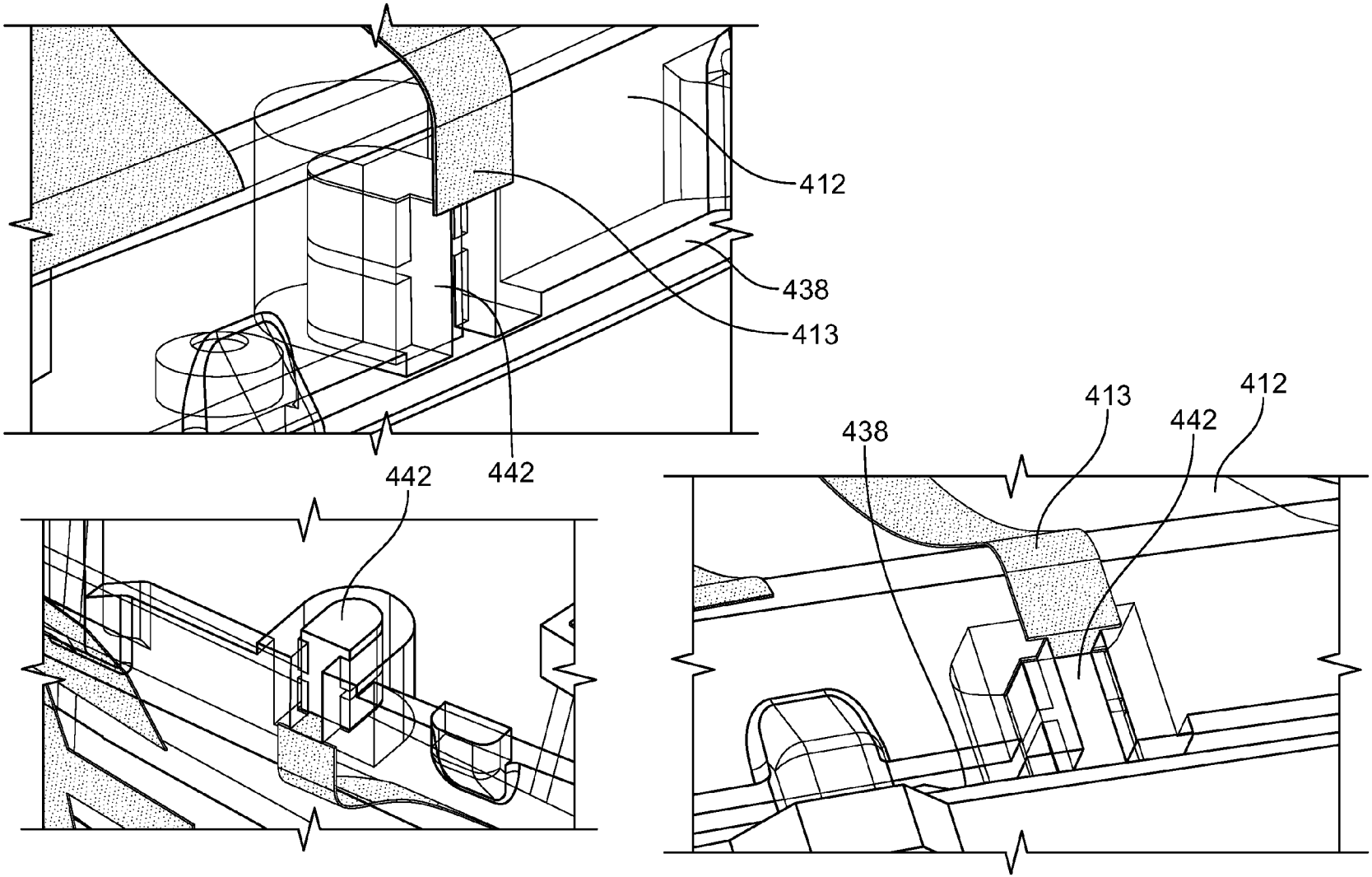
FIG. 10 is a perspective view showing molded interconnect devices being used to electrically connect a MIMO 3D antenna structure to a printed circuit board according to an exemplary embodiment.

FIG. 10 illustrates molded interconnect devices 442 (broadly, contact areas) being used to electrically connect a MIMO 3D antenna structure 413 to a printed circuit board 438. The antenna structure 413 is shaped or contoured in conformance with a shape or contour of the outer surface of the inner radome 412.

The molded interconnect devices (MID) 442 are located along the lower portion of the inner radome 412. The contact areas 442 are operable for electrically connecting antenna elements (e.g., MIMO 3D antenna structure 413, etc.) on the inner radome 412 to corresponding electrically conductive portions (e.g., traces, etc.) of the PCB 438. The contact areas 442 may be built as pads. In this example, the contact areas 442 comprise flexible electrically-conductive members that may be made of silver/copper silicone elastomer, etc.

FIG. 11 illustrates an exemplary manner by which an inner radome, cover or antenna carrier 512 may be coupled to a chassis 518 of an antenna assembly using screws 530 according to an exemplary embodiment. As shown in FIG. 11, a 3D antenna structure 513 is along the outer surface of the inner radome 512. The screws 530 may be used with a washer or silicon ring contact 531.

Figure 12:
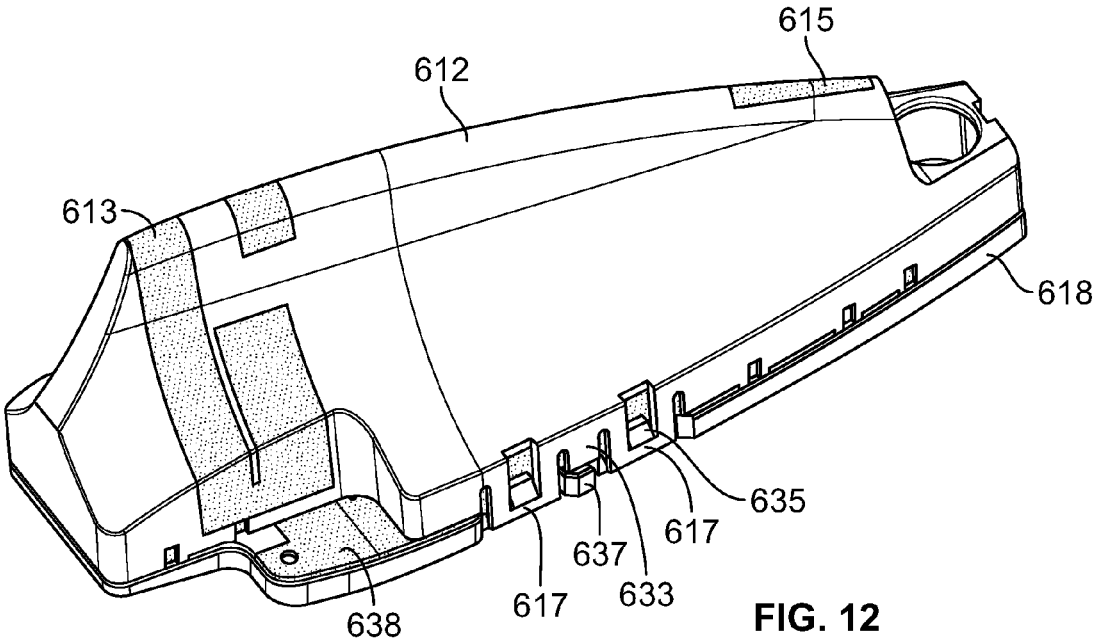
FIG. 12 is a perspective view of an inner radome, cover, or antenna carrier according to another exemplary embodiment that includes first and second MIMO antennas along outer surfaces of the inner radome, and illustrating an exemplary manner by which the inner radome may be coupled (e.g., snap clipped onto, latched, etc.) to a chassis of an antenna assembly according to an exemplary embodiment.

FIG. 12 illustrates an inner radome, cover, or antenna carrier 612 that may be used in exemplary embodiments of the present disclosure. For example, the inner radome 612 may be used in the antenna assembly 100 instead of the inner radome 112.

FIG. 12 also illustrates an exemplary manner by which the inner radome 612 may be coupled (e.g., latched, snap clipped onto, etc.) to a chassis 618 of an antenna assembly according to an exemplary embodiment. The inner radome 612 is configured to fit over one or more antennas (e.g., first and second antennas 120 and 122 in FIG. 1, etc.) and a PCB 638. The inner radome 612 is configured to be secured to the chassis 618. The inner radome 612 may secure to the chassis 618 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc.

In the illustrated embodiment shown in FIG. 12, the inner radome 612 includes latching or snap clip members 617 to allow the inner radome 612 to be latched or snap clipped onto the chassis 618. The latches or snap clip members 617 include openings configured to receive protruding portions or protrusions 635 (e.g., latches, hook shaped members, etc.) of the chassis 618. The inner radome 612 also includes a stop 633 between the latching or snap clip members 617. The stop 633 is configured to contact or abut against a corresponding portion or generally opposing stop 637 of the chassis 618. The stops 633, 637 are configured to be operable for limiting vertical downward motion of the inner radome 612 toward the chassis 618. Also, engagement of the inner radome's latching members 617 with the protrusions 635 of the chassis 618 limits vertical upward motion of the inner radome 612 away from the chassis 618. Accordingly, the latching members 617, protrusions 635, and stops 633, 637 are thus collectively operable for retaining the inner radome 612 to the chassis 618.

Also shown in FIG. 12, the inner radome 612 includes first and second antennas 613, 615. The antenna elements 613 and 615 extending along corresponding outer surface portions of the inner radome 612. The antenna elements 613, 615 are shaped or contoured in conformance with a shape or contour of the outer surface of the inner radome 612. The antenna elements 613, 615 generally follow the shape or contour of the respective back and front portions of the inner radome 612 along which they are positioned. By way of example, the antenna elements 613, 615 may comprise flex film antennas coupled (e.g., adhesively attached, etc.) to the inner radome 612. In other exemplary embodiments, a two shot molding process, selective plating process, and/or laser direct structuring (LDS) process may be used to provide the antenna elements 613, 615 on the inner radome or antenna carrier 612.

There are molded interconnect devices (MID) (broadly, contact areas) along the lower portion of the inner radome 612. The contact areas are operable for electrically connecting the antenna elements 613, 615 on the inner radome 612 to corresponding electrically conductive portions (e.g., traces, etc.) of a PCB 638. The contact areas may be built as pads. The contact areas may comprise flexible electrically-conductive members having a hollow profile (e.g., FIG. 7, etc.) and made of silver/copper silicone elastomer, etc.

A sample prototype antenna assembly having features similar to the corresponding features of the antenna assembly 100 shown in FIGS. 2 through 7 was constructed and tested. FIGS. 13 through 27 provide analysis results measured for the prototype antenna assembly. Generally, these results show that using an inner radome or cover as a carrier for 3D conformal antenna elements may allow better antenna performance to be achieved, such as for new services like LTE MIMO. These analysis results shown in FIGS. 13 through 27 are provided only for purposes of illustration and not for purposes of limitation. Alternative embodiments of the antenna assembly may be configured differently and have different operational or performance parameters than what is shown in FIGS. 13 through 27.

Figure 13:
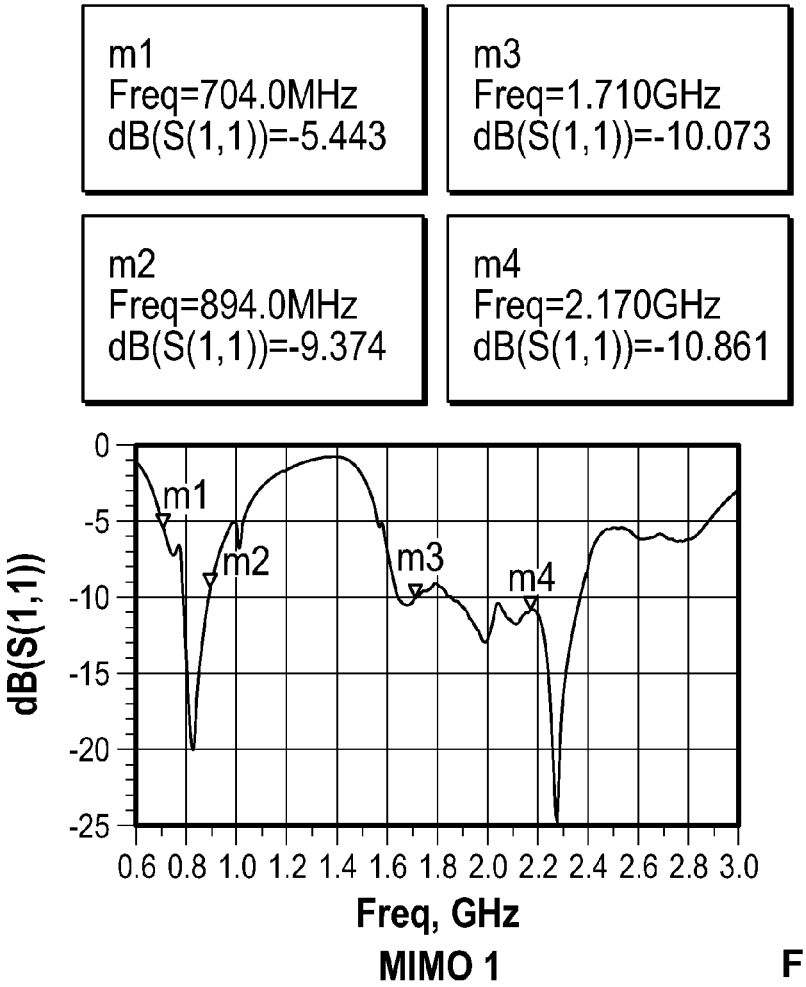
FIG. 13 is a line graph of measured reflection or matching S11 in decibels versus frequency in gigahertz for the first MIMO antenna (MIMO1) shown in FIG. 3.
Figure 15:
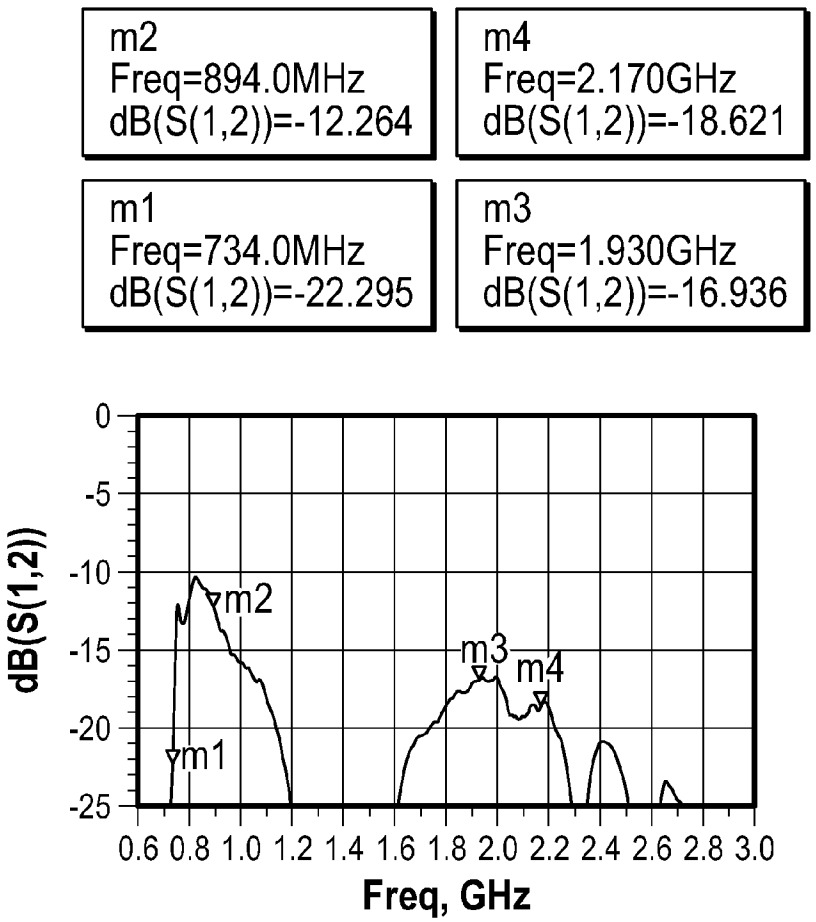
FIG. 15 is a line graph of measured port-to-port or mutual coupling S12 in decibels versus frequency in gigahertz for the first and second MIMO antennas (MIMO1 and MIMO2) respectively shown in FIGS. 3 and 4.
Figure 14:
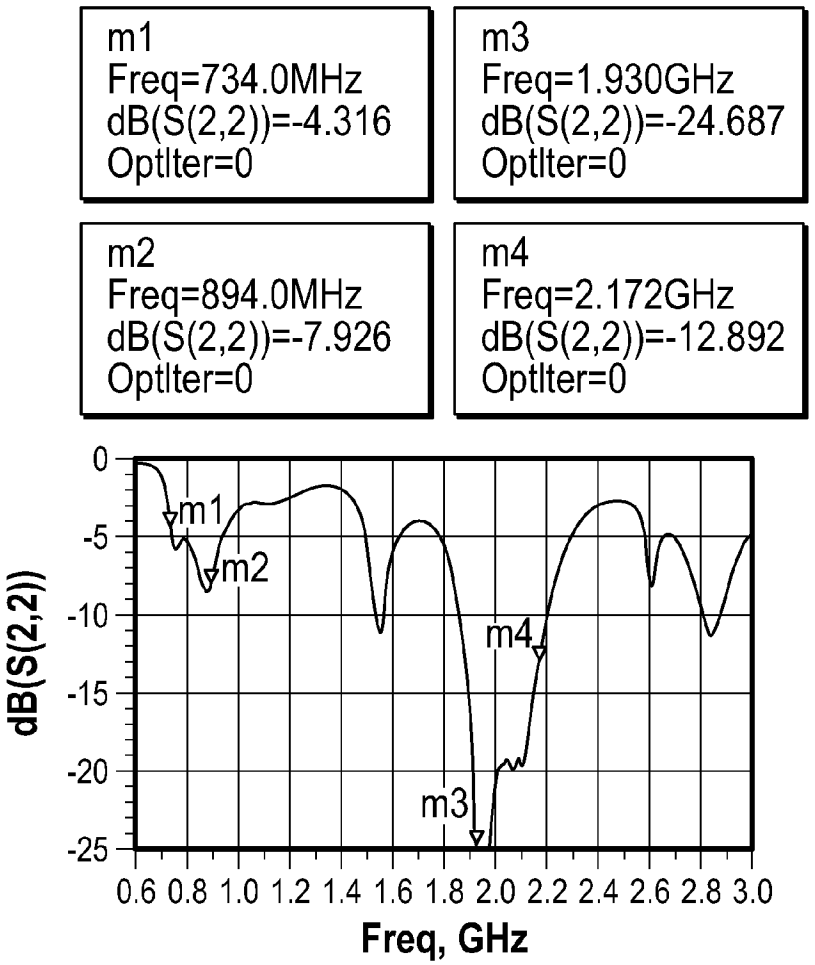
FIG. 14 is a line graph of measured reflection or matching S22 in decibels versus frequency in gigahertz for the second MIMO antenna (MIMO2) shown in FIG. 4.

More specifically, FIGS. 13 and 14 respectively show the measured reflection or matching S11 (FIG. 13) and S22 (FIG. 14). The S11 graph of FIG. 13 shows the first MIMO antenna feed point impedance. The S22 graph of FIG. 14 shows the second MIMO antenna feed point impedance. FIG. 15 shows port-to-port or mutual coupling S12 (FIG. 15) for the first and second MIMO antennas of the prototype antenna assembly. Generally, the S-parameters describe the input-output relationship between the ports or terminals of the antenna system.

FIG. 24 shows measured reflection or matching S22 in decibels versus SDARS frequencies for the second MIMO antenna of the prototype antenna assembly. The graph S11 of FIG. 24 shows the SDARS patch antenna feed point impedance.

As can be seen by FIGS. 13-15, the measured reflection S11, S22 and port-to-port coupling S12 remain low for LTE 700 frequencies, GSM 850 frequencies, GSM 1800 frequencies, GSM 1900 frequencies, and UMTS 2170 frequencies. The measured reflection S22 also remains low for SDARS frequencies as shown by FIG. 24.

Figure 16:
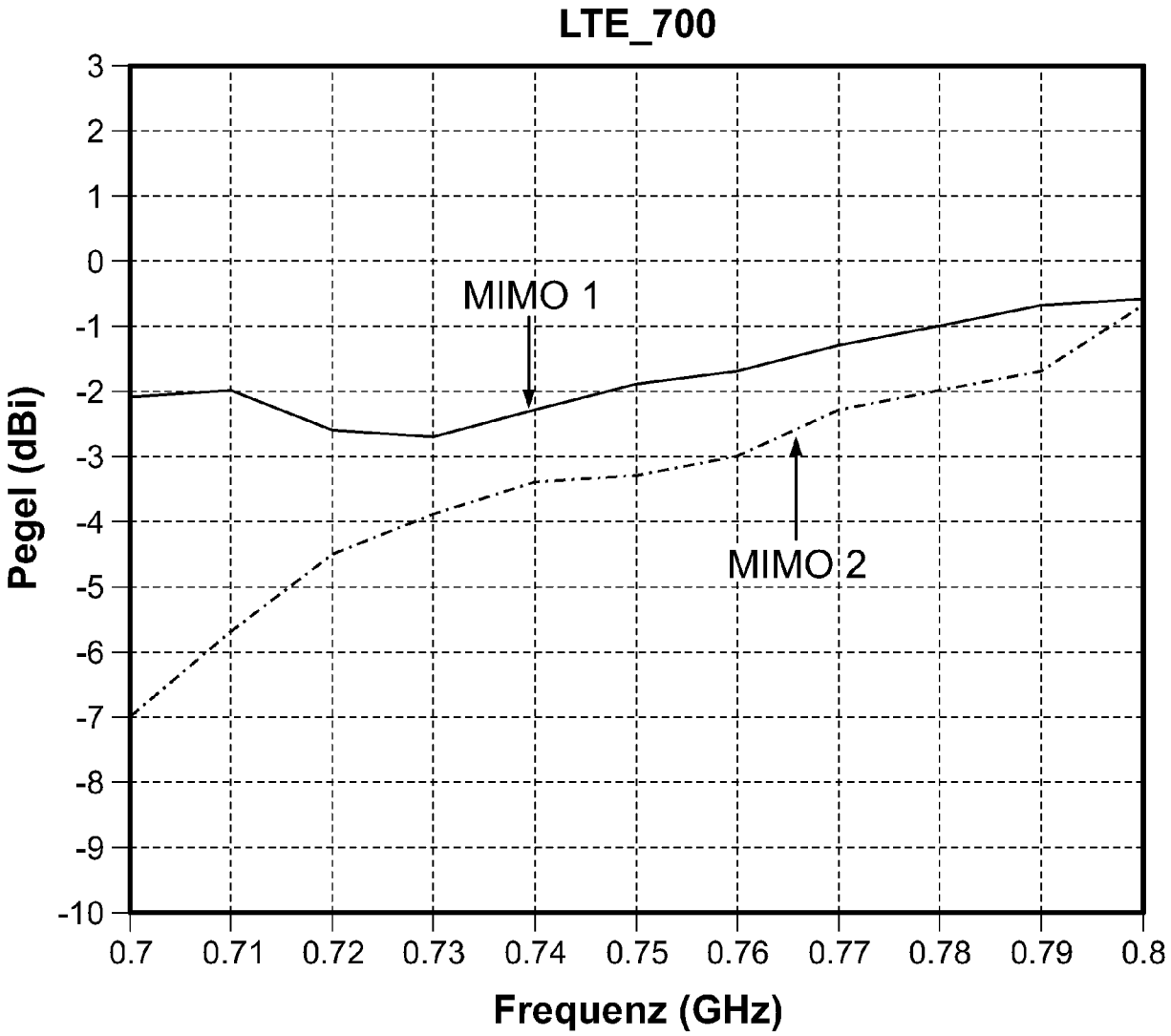
FIG. 16 is a level diagram in decibels-isotropic (dBi) versus LTE 700 frequencies in gigahertz measured for the first and second MIMO antennas respectively shown in FIGS. 3 and 4.

FIGS. 16, 18, and 20 are level diagrams measured for the first and second MIMO antennas of the prototype antenna assembly at LTE 700 frequencies (FIG. 16), GSM 850 frequencies (FIG. 18), and at DCS 1800 & PCS 1900, UMTS frequencies (FIG. 20). FIG. 16 shows the average antenna gain for the first and second MIMO antennas in azimuth cut at 700 MHz at low elevation angle (3°). FIG. 18 shows the average antenna gain for the first and second MIMO antennas in azimuth cut at 800 MHz at low elevation angle (3°). FIG. 20 shows the average antenna gain for the first and second MIMO antennas in azimuth cut at 1700-2170 MHz at low elevation angle (3°).

FIG. 26 is a level diagram measured for the first MIMO antenna of the prototype antenna assembly at elevation angle from 15 to 90 degrees at SDARS frequencies of 2320 MHz, 2335 MHz, and 2345 MHz. FIG. 26 shows the gain of the SDARS antenna vs. elevation angle in comparison to SXM (SiriusXM, SDARS system provider) approval level. As shown in FIG. 26, the prototype antenna assembly exceeds the SDARS approval level.

FIGS. 17, 19, 21, 22, and 23 include radiation patterns for the first and second MIMO antennas of the prototype antenna assembly at LTE 700 frequencies (FIG. 17), GSM 850 frequencies (FIG. 19), GSM 1800 frequencies (FIG. 21), GSM 1900 frequencies (FIG. 22), and UMTS 2170 frequencies (FIG. 23). FIG. 17 shows the radiation pattern for the first and second MIMO antennas in azimuth cut at 700 MHz and at elevation angle (3°). FIG. 19 shows the radiation pattern for the first and second MIMO antennas in azimuth cut at 800 MHz and at low elevation angle (3°). FIG. 21 shows the radiation pattern for the first and second MIMO antennas in azimuth cut at 1800 MHz at low elevation angle (3°). FIG. 22 shows the radiation pattern for the first and second MIMO antennas in azimuth cut at 1900 MHz at low elevation angle (3°). FIG. 23 shows the radiation pattern for the first and second MIMO antennas in azimuth cut at 2170 MHz at low elevation angle (3°).

FIG. 27 includes radiation patterns for the second MIMO antenna of the prototype antenna assembly measured at an SDARS frequency of 2335 MHz and at elevation angles of 20 degrees, 60 degrees, and 85 degrees. Generally, FIGS. 17, 19, 21, 22, 23, and 27 show that the prototype antenna assembly has good omnidirectional radiation patterns at LTE 700 frequencies (FIG. 17), GSM 850 frequencies (FIG. 19), GSM 1800 frequencies (FIG. 21), GSM 1900 frequencies (FIG. 22), UMTS 2170 frequencies (FIG. 23), and SDARS frequencies (FIG. 27).

FIG. 25 is a graph of voltage standing wave ratio (VSWR) S22 in decibels versus SDARS frequencies in gigahertz measured for the second MIMO antenna of the antenna assembly prototype. The smith chart of FIG. 25 shows the SDARS patch antenna feed point impedance.

Generally, FIG. 25 shows the prototype antenna assembly to have a good voltage standing wave ratio (VSWR) and relatively good efficiency at LTE 700 frequencies, GSM 850 frequencies, GSM 1800 frequencies, GSM 1900 frequencies, UMTS 2170 frequencies, and SDARS frequencies.

Exemplary embodiments of the antenna assemblies disclosed herein may be configured for use as a multiband multiple input multiple output (MIMO) antenna assembly that is operable in multiple frequency bands including one or more frequency bandwidths associated with cellular communications, Wi-Fi, DSRC (Dedicated Short Range Communication), satellite signals, terrestrial signals, etc. For example, exemplary embodiments of antenna assemblies disclosed herein may be operable in one or more or any combination (or all) of the following frequency bands: amplitude modulation (AM), frequency modulation (FM), global positioning system (GPS), global navigation satellite system (GLONASS), satellite digital audio radio services (SDARS) (e.g., Sirius XM Satellite Radio, etc.), AMPS, GSM850, GSM900, PCS, GSM1800, GSM1900, AWS, UMTS, digital audio broadcasting (DAB)-VHF-III, DAB-L, Long Term Evolution (e.g., 4G, 3G, other LTE generation, B17 (LTE), LTE (700 MHz), etc.), Wi-Fi, Wi-Max, PCS, EBS (Educational Broadband Services), BRS (Broadband Radio Services), WCS (Broadband Wireless Communication Services/Internet Services), cellular frequency bandwidth(s) associated with or unique to a particular one or more geographic regions or countries, one or more frequency bandwidth(s) from Table 1 and/or Table 2 below, etc.

TABLE 1

| System/Band Description | Upper Frequency (MHz) | Lower Frequency (MHz) |
|---|---|---|
| 700 MHz Band | 698 | 862 |
| B17 (LTE) | 704 | 787 |
| AMPS/GSM850 | 824 | 894 |
| GSM 900 (E-GSM) | 880 | 960 |
| DCS 1800/GSM1800 | 1710 | 1880 |
| PCS/GSM1900 | 1850 | 1990 |
| W CD MA/UMTS | 1920 | 2170 |
| 2.3 GHz Band IMT Extension | 2300 | 2400 |
| IEEE 802.11B/G | 2400 | 2500 |
| EBS/BRS | 2496 | 2690 |
| WiIMAX MMDS | 2500 | 2690 |
| BROADBAND RADIO SERVICES/BRS (MMDS) | 2700 | 2900 |
| W IMAX (3.5 GHz) | 3400 | 3600 |
| PUBLIC SAFETY RADIO | 4940 | 4990 |

TABLE 2

| | Tx/Uplink (MHz) | | Rx/Downlink (MHz) | |
|---|---|---|---|---|
| Band | Start | Stop | Start | Stop |
| GSM 850/AMP | 824.00 | 849.00 | 869.00 | 894.00 |
| GSM 900 | 876.00 | 914.80 | 915.40 | 959.80 |
| AWS | 1710.00 | 1755.80 | 2214.00 | 2180.00 |
| GSM 1800 | 1710.20 | 1784.80 | 1805.20 | 1879.80 |
| GSM 1900 | 1850.00 | 1910.00 | 1930.00 | 1990.00 |

TABLE 2-continued

| Band | Tx/Uplink (MHz) Start | Tx/Uplink (MHz) Stop | Rx/Downlink (MHz) Start | Rx/Downlink (MHz) Stop |
|---|---|---|---|---|
| UMTS | 1920.00 | 1980.00 | 2110.00 | 2170.00 |
| LTE | 2010.00 | 2025.00 | 2010.00 | 2025.00 |
| LTE | 2300.00 | 2400.00 | 2300.00 | 2400.00 |
| LTE | 2496.00 | 2690.00 | 2496.00 | 2690.00 |
| LTE | 2545.00 | 2575.00 | 2545.00 | 2575.00 |
| LTE | 2570.00 | 2620.00 | 2570.00 | 2620.00 |

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiband multiple input multiple output (MIMO) vehicular antenna assembly for installation to a vehicle body wall, the antenna assembly comprising:

a chassis;

an outer radome coupled to the chassis such that an interior enclosure is collectively defined by the outer radome and the chassis;

an inner radome within the interior enclosure and having inner and outer surfaces spaced apart from the chassis and the outer radome;

at least one antenna element within the interior enclosure between the inner surface of the inner radome and the chassis; and at least one antenna element along a portion of the inner radome so as to generally follow a curved or non-flat contour of the portion of the inner radome;

wherein the at least one antenna element along the portion of the inner radome comprises:

a first MIMO antenna element located along a back outer surface portion of the inner radome such that the first MIMO antenna element generally follows a contour of the back outer surface portion of the inner radome; and a second MIMO antenna element located along a front outer surface portion of the inner radome such that the second MIMO antenna element generally follows a contour of the front outer surface portion of the inner radome.

2. The antenna assembly of claim 1, wherein:

the at least one antenna element along the portion of the inner radome comprises at least two 3D antenna elements along a curved outer surface of the inner radome that are spaced apart from the chassis and the outer radome; and the antenna assembly further comprises a printed circuit board between the chassis and the inner radome, and the at least one antenna element within the interior enclosure between the chassis and the inner surface of the inner radome is between the printed circuit board and the inner surface of the inner radome.

3. The antenna assembly of claim 1, wherein the at least one antenna element along the portion of the inner radome comprises at least one flex film antenna attached to a curved outer surface of the inner radome, the at least one flex film antenna is flexed, bent, curved, or shaped in conformance with a curved contour of the curved outer surface of the inner radome.

4. The antenna assembly of claim 1, wherein:

the at least one antenna element within the interior enclosure between the chassis and the inner surface of the inner radome is configured to be operable for receiving satellite signals; and the at least one antenna element along the portion of the inner radome is configured to be operable for receiving and transmitting communication signals within one or more cellular frequency bands; and the outer radome is configured so as to seal the antenna assembly against the ingress of water.

5. The antenna assembly of claim 1, wherein the at least one antenna along the portion of the inner radome is along a curved outer surface of the inner radome so as to generally follow a curved contour of the curved outer surface of the inner radome along which the at least one antenna element is positioned.

6. A multiband multiple input multiple output (MIMO) vehicular antenna assembly for installation to a vehicle body wall, the antenna assembly comprising:

a chassis;

an outer radome coupled to the chassis such that an interior enclosure is collectively defined by the outer radome and the chassis;

an inner radome within the interior enclosure and having inner and outer surfaces spaced apart from the chassis and the outer radome;

at least one antenna element within the interior enclosure between the inner surface of the inner radome and the chassis; and at least one antenna element along a portion of the inner radome so as to generally follow a curved or non-flat contour of the portion of the inner radome;

wherein:

the at least one antenna element along a portion of the inner radome comprises first and second antenna elements; and the inner radome comprises multiple pieces including a back piece having the first antenna element thereon, a front piece having the second antenna element thereon, and a middle piece attachable between the front and back pieces; and the front and back pieces include protruding portions that are engageable within corresponding slots in the middle piece.

7. A multiband multiple input multiple output (MIMO) vehicular antenna assembly for installation to a vehicle body wall, the antenna assembly comprising:

a chassis;

an outer radome coupled to the chassis such that an interior enclosure is collectively defined by the outer radome and the chassis;

an inner radome within the interior enclosure and having inner and outer surfaces spaced apart from the chassis and the outer radome;

one or more antenna elements within the interior enclosure between the inner surface of the inner radome and the chassis;

one or more antenna elements along a portion of the inner radome so as to generally follow a contour of the portion of the inner radome; and one or more molded interconnect devices and/or one or more contact areas along a lower portion of the inner radome for electrically connecting the one or more antenna elements along the portion of the inner radome to corresponding electrically-conductive portions of a printed circuit board.

8. The antenna assembly of claim 7, wherein the at least one antenna element along the portion of the inner radome comprises:

a first MIMO antenna element located along a back outer surface portion of the inner radome such that the first MIMO antenna element generally follows a contour of the back outer surface portion of the inner radome; and a second MIMO antenna element located along a front outer surface portion of the inner radome such that the second MIMO antenna element generally follows a contour of the front outer surface portion of the inner radome.

9. A multiband multiple input multiple output (MIMO) vehicular antenna assembly for installation to a vehicle body wall, the antenna assembly comprising:

a chassis;

an outer radome coupled to the chassis such that an interior enclosure is collectively defined by the outer radome and the chassis;

an inner radome within the interior enclosure and having inner and outer surfaces spaced apart from the chassis and the outer radome;

one or more antenna elements within the interior enclosure between the inner surface of the inner radome and the chassis;

one or more antenna elements along a portion of the inner radome so as to generally follow a contour of the portion of the inner radome; and one or more contact areas along a lower portion of the inner radome for electrically connecting the one or more antenna elements along the portion of the inner radome to corresponding electrically-conductive portions of a printed circuit board, wherein the one or more contact areas include one or more electrically-conductive silicone elastomer members having a hollow profile.

10. A multiband multiple input multiple output (MIMO) vehicular antenna assembly for installation to a vehicle body wall, the antenna assembly comprising:

a chassis;

an outer radome coupled to the chassis such that an interior enclosure is collectively defined by the outer radome and the chassis;

an inner radome within the interior enclosure and having inner and outer surfaces spaced apart from the chassis and the outer radome;

at least one antenna element within the interior enclosure between the inner surface of the inner radome and the chassis; and at least one antenna element along a portion of the inner radome so as to generally follow a curved or non-flat contour of the portion of the inner radome;

wherein:

the at least one antenna element within the interior enclosure between the chassis and the inner surface of the inner radome comprises a first patch antenna configured to be operable for receiving satellite digital audio radio services (SDARS) signals, and a second patch antenna configured to be operable for receiving global positioning system (GPS) signals; and the at least one antenna element along the portion of the inner radome is configured to be operable with Long Term Evolution (LTE) frequencies, Wi-Fi, and Dedicated Short Range Communication (DSRC); and the inner radome includes latching or snap clip members to allow the inner radome to be latched or snap clipped onto the chassis.

11. A multiband multiple input multiple output (MIMO) vehicular antenna assembly for installation to a vehicle body wall, the antenna assembly comprising:

a chassis;

an outer radome coupled to the chassis such that an interior enclosure is collectively defined by the outer radome and the chassis;

an inner radome within the interior enclosure and having inner and outer surfaces spaced apart from the chassis and the outer radome;

at least one antenna element within the interior enclosure between the inner surface of the inner radome and the chassis; and at least one antenna element along a portion of the inner radome so as to generally follow a curved or non-flat contour of the portion of the inner radome;

wherein:

the at least one antenna element along the portion of the inner radome comprises a monopole antenna configured to be operable for receiving and transmitting communication signals within one or more cellular frequency bands, and an inverted F antenna configured to be operable for receiving communication signals within one or more cellular frequency bands; and the at least one antenna element within the interior enclosure between the chassis and the inner surface of the inner radome comprises a first patch antenna configured to be operable for receiving satellite signals, and a second patch antenna configured to be operable for receiving satellite signals different than the satellite signals received by the first patch antenna.

12. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

at least one antenna element within the interior enclosure between the inner surface of the antenna carrier and the printed circuit board; and at least one antenna element along a portion of the antenna carrier so as to generally follow a curved or non-flat contour of the portion of the antenna carrier;

wherein the at least one antenna element along the portion of the antenna carrier comprise:

a first MIMO antenna element located along a back outer surface portion of the antenna carrier such that the first MIMO antenna element generally follows a contour of the back outer surface portion of the antenna carrier; and a second MIMO antenna element located along a front outer surface portion of the antenna carrier such that the second MIMO antenna element generally follows a contour of the front outer surface portion of the antenna carrier.

13. The antenna assembly of claim 12, wherein the at least one antenna element along the portion of the antenna carrier comprises at least two 3D antenna elements along a curved outer surface of the antenna carrier that are spaced apart from the chassis and the outer radome.

14. The antenna assembly of claim 12, wherein the at least one antenna element along the portion of the antenna carrier comprises at least one flex film antenna attached to a curved outer surface of the antenna carrier, the at least one flex film antenna is flexed, bent, curved, or shaped in conformance with a curved contour of the curved outer surface of the antenna carrier.

15. The antenna assembly of claim 12, wherein:

the at least one antenna element along the portion of the antenna carrier comprise first and second antenna elements; and the antenna carrier comprises multiple pieces including a back piece having the first antenna element thereon, a front piece having the second antenna element thereon, and a middle piece attachable between the front and back pieces.

16. The antenna assembly of claim 12, wherein the at least one antenna element along the portion of the antenna carrier is along a curved outer surface of the antenna carrier so as to generally follow a curved contour of the curved outer surface of the antenna carrier along which the at least one antenna element is positioned.

17. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

one or more antenna elements within the interior enclosure between the inner surface of the antenna carrier and the printed circuit board;

one or more antenna elements along a portion of the antenna carrier so as to generally follow a contour of the portion of the antenna carrier; and one or more molded interconnect devices and/or one or more contact areas along a lower portion of the antenna carrier for electrically connecting the one or more antenna elements along the portion of the antenna carrier to corresponding electrically-conductive portions of the printed circuit board.

18. The antenna assembly of claim 17, wherein the at least one antenna element along the portion of the antenna carrier comprise:

a first MIMO antenna element located along a back outer surface portion of the antenna carrier such that the first MIMO antenna element generally follows a contour of the back outer surface portion of the antenna carrier; and a second MIMO antenna element located along a front outer surface portion of the antenna carrier such that the second MIMO antenna element generally follows a contour of the front outer surface portion of the antenna carrier.

19. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

at least one antenna element within the interior enclosure between the inner surface of the antenna carrier and the printed circuit board; and at least one antenna element along a portion of the antenna carrier so as to generally follow a curved or non-flat contour of the portion of the antenna carrier;

wherein:

the at least one antenna element within the interior enclosure between the inner surface of the antenna carrier and the printed circuit board is configured to be operable for receiving satellite signals; and the at least one antenna element along the portion of the antenna carrier is configured to be operable for receiving and transmitting communication signals within one or more cellular frequency bands; and the antenna carrier includes latching or snap clip members to allow the antenna carrier to be latched or snap clipped onto the chassis.

20. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

at least one antenna element within the interior enclosure between the inner surface of the antenna carrier and the printed circuit board; and at least one antenna element along a portion of the antenna carrier so as to generally follow a curved or non-flat contour of the portion of the antenna carrier;

wherein:

the at least one antenna element within the interior enclosure between the inner surface of the antenna carrier and the printed circuit board comprises a first patch antenna configured to be operable for receiving satellite digital audio radio services (SDARS) signals, and a second patch antenna configured to be operable for receiving global positioning system (GPS) signals; and the at least one antenna element along the portion of the antenna carrier is configured to be operable with Long Term Evolution (LTE) frequencies, Wi-Fi, and Dedicated Short Range Communication (DSRC); and the outer radome is configured so as to seal the antenna assembly against the ingress of water.

21. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

at least one antenna element within the interior enclosure between the inner surface of the antenna carrier and the printed circuit board; and at least one antenna element along a portion of the antenna carrier so as to generally follow a curved or non-flat contour of the portion of the antenna carrier;

wherein the at least one antenna element along the portion of the antenna carrier comprise:

a monopole antenna configured to be operable for receiving and transmitting communication signals within one or more cellular frequency bands; and an inverted F antenna configured to be operable for receiving communication signals within one or more cellular frequency bands; and wherein the at least one antenna element within the interior enclosure between the inner surface of the antenna carrier and the printed circuit board comprises:

a first patch antenna configured to be operable for receiving satellite signals; and a second patch antenna configured to be operable for receiving satellite signals different than the satellite signals received by the first patch antenna.

22. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

at least one antenna element within the interior enclosure between the inner surface of the antenna carrier and the printed circuit board; and at least one antenna element along a portion of the antenna carrier so as to generally follow a curved or non-flat contour of the portion of the antenna carrier;

at least one contact member comprising electrically-conductive elastomer and positioned within an opening along a lower portion of the inner radome for electrically connecting the at least one element along the portion of the inner radome to a corresponding electrically conductive portion of the printed circuit board.

23. A multiband multiple input multiple output (MIMO) vehicular antenna assembly for installation to a vehicle body wall, the antenna assembly comprising:

a chassis;

an outer cover coupled to the chassis such that an interior enclosure is collectively defined by the outer cover and the chassis;

an antenna carrier within the interior enclosure and having inner and outer surfaces spaced apart from the chassis and the outer cover;

a printed circuit board between the chassis and the antenna carrier;

at least one antenna element within the interior enclosure between the inner surface of the antenna carrier and the printed circuit board; and at least one antenna element along a portion of the antenna carrier so as to generally follow a curved or non-flat contour of the portion of the antenna carrier;

wherein:

the outer radome is configured so as to seal the antenna assembly against the ingress of water; and the inner radome includes latching or snap clip members to allow the inner radome to be latched or snap clipped onto the chassis.

* * * * *